US009021762B1

(12) United States Patent
DePalma

(10) Patent No.: US 9,021,762 B1
(45) Date of Patent: May 5, 2015

(54) INTERLOCKING CONCRETE BLOCKS WITH TRAPEZOIDAL SHAPE

(71) Applicant: Frank DePalma, Brooklyn, NY (US)

(72) Inventor: Frank DePalma, Brooklyn, NY (US)

( * ) Notice: Subject to any disclaimer, the term of this patent is extended or adjusted under 35 U.S.C. 154(b) by 0 days.

(21) Appl. No.: 14/174,623

(22) Filed: Feb. 6, 2014

(51) Int. Cl.
*E04B 5/04* (2006.01)
*E04C 2/04* (2006.01)
*E04B 2/14* (2006.01)

(52) U.S. Cl.
CPC ..... *E04B 2/14* (2013.01)

(58) Field of Classification Search
CPC ..... E04B 2002/0206; E04B 2002/0269; E04B 2002/0208; E04C 1/00; E04C 3/00
USPC ..... 52/596, 608, 605, 606, 607
See application file for complete search history.

(56) References Cited

U.S. PATENT DOCUMENTS

| | | | | | |
|---|---|---|---|---|---|
| 1,072,293 | A | * | 9/1913 | Zeimet | 52/206 |
| 1,606,150 | A | * | 11/1926 | Curtis | 52/506.03 |
| 2,114,244 | A | * | 4/1938 | Zoettl | 52/100 |
| 2,141,397 | A | * | 12/1938 | Locke | 52/204.2 |
| 2,308,790 | A | * | 1/1943 | Stagg | 52/550 |
| 2,392,551 | A | * | 1/1946 | Roe | 52/586.2 |
| 2,736,188 | A | * | 2/1956 | Wilhelm | 52/560 |
| 2,861,388 | A | * | 11/1958 | Favaretto | 446/124 |
| 3,717,967 | A | * | 2/1973 | Wood | 52/259 |
| 3,822,569 | A | * | 7/1974 | Lautrup-Larsen | 446/85 |
| 3,962,842 | A | * | 6/1976 | Wilhelm | 52/436 |
| 3,968,615 | A | * | 7/1976 | Ivany | 52/439 |
| 4,015,391 | A | * | 4/1977 | Epstein et al. | 52/520 |
| 4,075,808 | A | * | 2/1978 | Pearlman | 52/439 |
| 4,167,840 | A | * | 9/1979 | Ivany | 52/438 |
| 4,320,606 | A | * | 3/1982 | GangaRao | 52/125.5 |
| 4,597,236 | A | * | 7/1986 | Braxton | 52/564 |
| 4,643,427 | A | * | 2/1987 | Wozniak | 273/160 |
| 4,726,567 | A | * | 2/1988 | Greenberg | 256/19 |
| 5,365,714 | A | * | 11/1994 | Potvin | 52/590.2 |
| 5,507,127 | A | * | 4/1996 | Gates | 52/605 |
| 5,711,130 | A | * | 1/1998 | Shatley | 52/604 |
| 6,065,265 | A | * | 5/2000 | Stenekes | 52/607 |
| 6,082,067 | A | * | 7/2000 | Bott | 52/592.3 |
| 6,098,357 | A | * | 8/2000 | Franklin et al. | 52/223.7 |
| 6,226,951 | B1 | * | 5/2001 | Azar | 52/604 |
| 6,244,009 | B1 | * | 6/2001 | Cerrato | 52/604 |
| D464,441 | S | * | 10/2002 | Luaces | D25/114 |
| 6,588,168 | B2 | * | 7/2003 | Walters | 52/604 |
| 6,735,913 | B2 | * | 5/2004 | Sanders et al. | 52/284 |
| 7,007,436 | B1 | * | 3/2006 | Kelley | 52/605 |
| 7,117,647 | B2 | * | 10/2006 | Clarke | 52/233 |
| 7,461,490 | B2 | * | 12/2008 | Toledo | 52/605 |
| 7,584,584 | B2 | * | 9/2009 | Fennell, Jr. | 52/607 |
| 8,061,095 | B2 | * | 11/2011 | Bucheger | 52/223.7 |
| 8,266,855 | B1 | * | 9/2012 | Altararwah | 52/284 |
| 8,464,482 | B2 | * | 6/2013 | Raynor | 52/296 |
| 8,667,760 | B2 | * | 3/2014 | Drew | 52/600 |

(Continued)

FOREIGN PATENT DOCUMENTS

WO WO 2012104685 A1 * 8/2012

*Primary Examiner* — Mark Wendell
*Assistant Examiner* — Keith Minter
(74) *Attorney, Agent, or Firm* — Oakwood Law Group, LLP

(57) ABSTRACT

The present invention relates to concrete blocks or cement blocks that are shaped along the front surface like a wood shingle. In this way, when a user builds an outside wall out of these cement blocks, water will run down the side of the wall and not get into any of the joints where one block connects with the other. The blocks are all pre-made, sent to an end-user, and the end-user stacks them to create a wall.

14 Claims, 87 Drawing Sheets

(56) References Cited

U.S. PATENT DOCUMENTS

| | | | | |
|---|---|---|---|---|
| 2002/0021042 | A1* | 2/2002 | Damron | 299/12 |
| 2002/0043038 | A1* | 4/2002 | Cerrato | 52/604 |
| 2003/0070386 | A1* | 4/2003 | Hampton | 52/606 |
| 2003/0070388 | A1* | 4/2003 | Catani et al. | 52/677 |
| 2004/0020145 | A1* | 2/2004 | Matsufuji | 52/223.7 |
| 2005/0108972 | A1* | 5/2005 | Banova | 52/596 |
| 2005/0115185 | A1* | 6/2005 | Telford et al. | 52/596 |
| 2005/0252118 | A1* | 11/2005 | Matsufuji | 52/223.7 |
| 2005/0284077 | A1* | 12/2005 | Spratlen et al. | 52/606 |
| 2006/0000179 | A1* | 1/2006 | Albert | 52/606 |
| 2006/0059839 | A1* | 3/2006 | Azar | 52/606 |
| 2006/0168907 | A1* | 8/2006 | Thorpe | 52/309.12 |
| 2007/0056235 | A1* | 3/2007 | Kohler | 52/223.7 |
| 2007/0107364 | A1* | 5/2007 | Estes et al. | 52/606 |
| 2007/0245673 | A1* | 10/2007 | Cerrato | 52/607 |
| 2008/0120931 | A1* | 5/2008 | Joslyn | 52/293.3 |
| 2009/0025333 | A1* | 1/2009 | Moroschan | 52/742.13 |
| 2009/0188186 | A1* | 7/2009 | Ebanks | 52/253 |
| 2009/0235606 | A1* | 9/2009 | Ness et al. | 52/596 |
| 2010/0043335 | A1* | 2/2010 | O'Connor | 52/592.6 |
| 2011/0247289 | A1* | 10/2011 | Schmidt | 52/561 |
| 2013/0333313 | A1* | 12/2013 | Alsayed et al. | 52/220.1 |
| 2014/0053493 | A1* | 2/2014 | Carey | 52/604 |

* cited by examiner

INTERLOCKING CONCRETE BLOCKS WITH TRAPEZOIDAL SHAPE

BACKGROUND OF THE INVENTION

1. Field of the Invention

This invention relates to concrete blocks used for constructing readily and inexpensively walls for buildings and the like, and more particularly to a set of concrete blocks that can interlock with each other.

2. Description of Related Art

A concrete block also called cement block and foundation block is usually a large rectangular brick used in construction.

A standard cement block is rectangular in shape and has 2-4 cores with a solid web transversing between cores although two cores are the most common configuration. The standard width of said rectangular block being 7 and ⅝ inches. The standard length of said rectangular block being 15 and ⅝ inches.

When rectangular cement blocks of the prior art are used to fabricate walls, the shape of the wall is essentially a straight linear wall with a vertical surface is created. Thus, water easily gets into the joints where one block connects with the other.

Therefore it is an object of this invention to provide an improvement which overcomes the aforementioned inadequacy of the prior art and provides improved concrete blocks which can let water run down along the slanted front surface of the wall and thus preventing water from getting into the joints where one block connects with the other.

The male side of the block has a vertical keyway to allow concrete grout in—to encapsulate the entire block creating a seal.

In addition, when rectangular cement blocks of the prior art are used to fabricate walls, sometimes, the corners of the rectangular shaped cement blocks need to be cut in order to match the desired angle or for different purposes. This technique is time consuming and requires a skilled mason to cut each and every block at the desired angle. It is well known that structures utilizing masonry techniques have become increasingly costly.

The fins have a large cut out to allow concrete grout through and allow for strong support.

Therefore, it is another object of this invention to provide a set of improved concrete blocks that overcomes the need of costly masonry techniques and can also prevent water from running into joints between blocks.

Moreover, properly aligning concrete blocks to build a wall is time consuming. The present invention also features a set of interlocking concrete blocks which can interlock with each other vertically and horizontally, allowing a concrete wall to be easily and quickly constructed.

SUMMARY OF THE INVENTION

In an exemplary embodiment of the present invention, there are disclosed concrete blocks, each of which has a substantially trapezoidal shape, being wider at their bottom than at their top. In this way, when a user builds a wall out of these cement blocks, the wall shaped along the front surface like a wall built out of wood shingle. Water will run down the side of the wall and not get into any of the joints where one block connects with the other.

Using a standard concrete block of prior art as an example, a standard concrete block of prior art has an equal width on the top and bottom (typically being 7 and ⅝ inches). However, the standard block of the present invention has a width at the bottom larger than the width at the top.

The present invention includes concrete blocks of a variety of specialized shapes to allow special construction features. Other than the most frequently used standard blocks, the present invention includes bond beam block, right out corner block, left out corner block, right flush block, left flush block, right half flush block, left half flush block, left in corner block, and right in corner block. All of these embodiments have a rear shell which faces inwards and a front shell which faces outwards. The rear shell is planar, meaning the width is same from top to bottom. The front shell is trapezoidal shaped, meaning that the front shell extends downwardly and outwardly and is wider at bottom than at top. These concrete blocks are pre-made and sent to the end-user who then uses these pre-made blocks to create a wall. With this configuration, as seen in the figures shown later, water will be prevented from getting into the joints where damage will normally result.

The present invention also features a set of interlocking concrete blocks which can interlock with each other vertically and horizontally, allowing a concrete wall to be easily and quickly constructed.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 1E top view, of the first embodiment of the concrete block according to the present invention (standard block) which is used in most area of a wall.

FIG. 1F bottom view, of the first embodiment of the concrete block according to the present invention (standard block) which is used in most area of a wall.

FIG. 1G shows a front perspective view, of the first embodiment of the concrete block according to the present invention (standard block) which is used in most area of a wall.

FIG. 1 H shows a bottom perspective view of the first embodiment of the concrete block according to the present invention (standard block) which is used in most area of a wall.

DESCRIPTION OF THE PREFERRED EMBODIMENT

The present invention features a building block system 100 comprising a plurality of interlocking concrete blocks. The system features an improved design for concrete blocks. The blocks of the present invention are substantially trapezoidal in shape. Therefore, a wall built out of these interlocking blocks of the present invention is shaped along the front surface like a wall built out of wood or vinyl shingles. In this way, when a user builds an outside wall out of these cement blocks, water will run down the side of the wall and not get into any of the joints where one block connects with the other.

Figure 11:
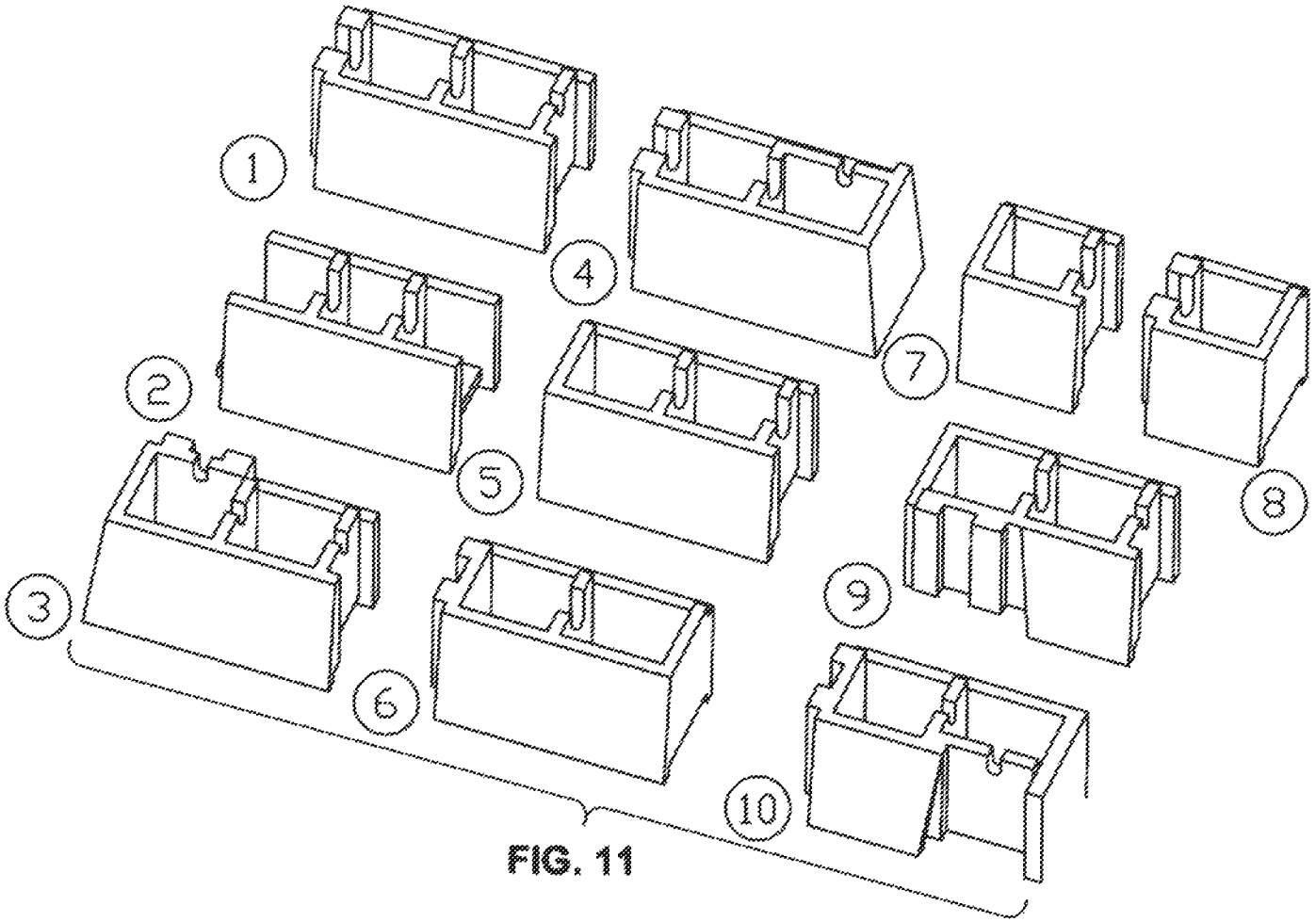
FIG. 11 shows the front perspective views of all the concrete blocks included in the system of the present invention.

As shown in FIG. 11, the system 100 of the present invention comprises a standard block 1, a bond block 2, a right out corner block 3, a left out corner block 4, a right flush corner block 5, a left flush corner block 6, a right half flush block 7, a left half flush block 8, a left in corner block 9, and a right in corner block 10. The bond beam 2 is used in a wall to form the top of an entry or a door. The right and left out corner blocks 3, 4 are used to create an angle of a wall. The right and left flush corner blocks 5, 6 and right and left half flush corner blocks are used on a wall along the two sides of an entry or a door. The left and right in corner blocks 9, 10 are also used to create an angle of a wall. The standard block is used in the rest area of a wall.

Figure 12:
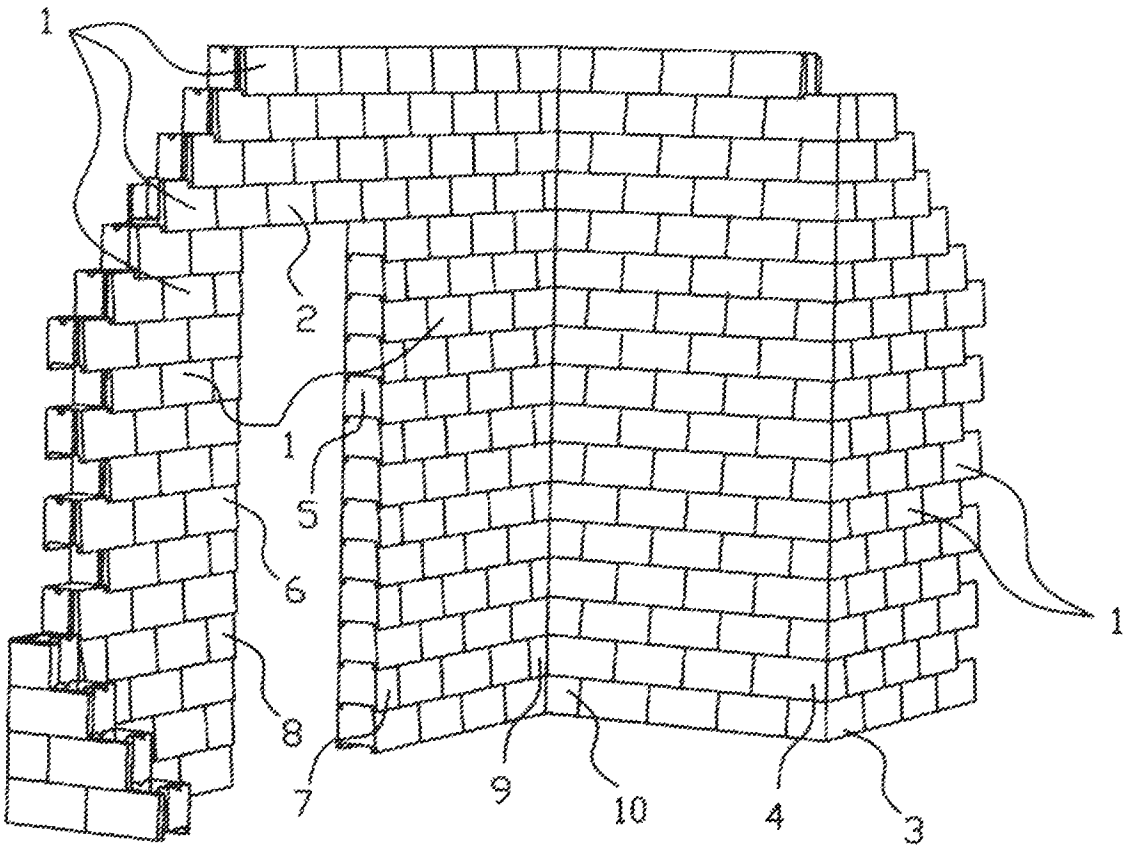
FIG. 12 shows a wall that is built using the concrete blocks of the present invention.

Before turning to a description of the blocks of the present invention, reference is made to FIG. 12, wherein a wall is shown constructed of a building block system 100 in accordance with the present invention. As it is clearly seen in FIG.

12, the wall built out of the concrete blocks of the present invention is shaped along the front surface like a wall built out of wood or vinyl shingles. The locations of the individual type of the concrete blocks are indicated in the figure.

Referring now to FIGS. 1-10 there disclosed different views of each type of interlocking blocks included in the system 100 according to the present invention.

Although each type of blocks has their own unique structural features in order to perform different functions for constructing a wall or a building, in general, they are substantially trapezoidal in shape, being wider at their bottom (W2) than at their top (W1), as can be seen from their side views (FIGS. 1C, 1D, 2C, 2D, 3C, 3D, 4C, 4D, 5C, 5D, 6C, 6D, 7C, 7D, 8C, 8D, 9C, 9D, 10C, and 10D). All types of blocks comprise a front shell 11 also called face shell which faces towards outside and a rear shell 12 which faces towards inside and may be in contact with an interior finish wall if there is any when these concrete blocks are used to build a wall. The rear shell 12 of the concrete blocks of the present invention is planar, having a uniform thickness from top 121 to bottom 122. However, the front shell 11 of the concrete blocks of the present invention is trapezoidal in shape, being wider near the bottom 112 than the top 111.

Figure 1A:
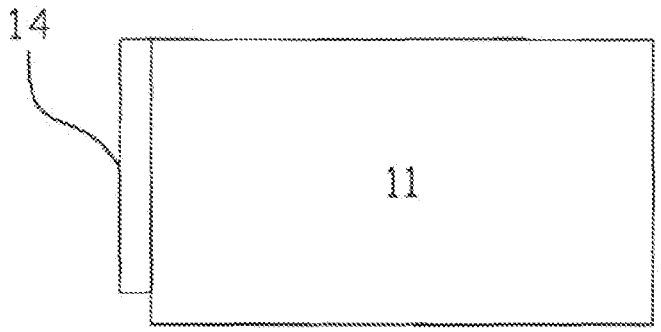
FIG. 1A shows the front view, of the first embodiment of the concrete block according to the present invention (standard block) which is used in most area of a wall.
Figure 1B:
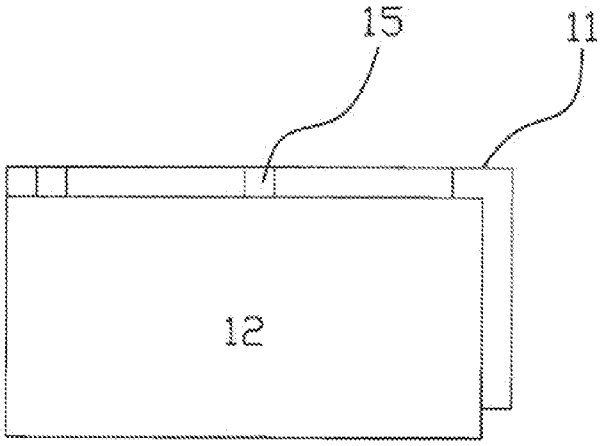
FIG. 1B shows the back view, of the first embodiment of the concrete block according to the present invention (standard block) which is used in most area of a wall.
Figure 1C:
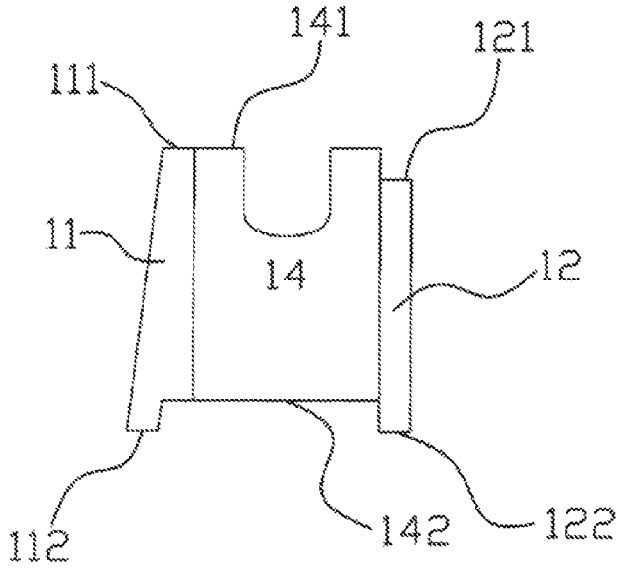
FIG. 1C shows the left view, of the first embodiment of the concrete block according to the present invention (standard block) which is used in most area of a wall.
Figure 1D:
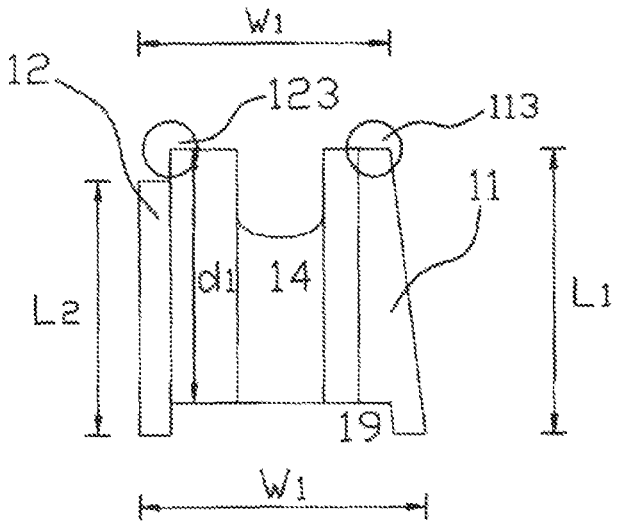
FIG. 1D shows the right view, of the first embodiment of the concrete block according to the present invention (standard block) which is used in most area of a wall.
Figure 1E:
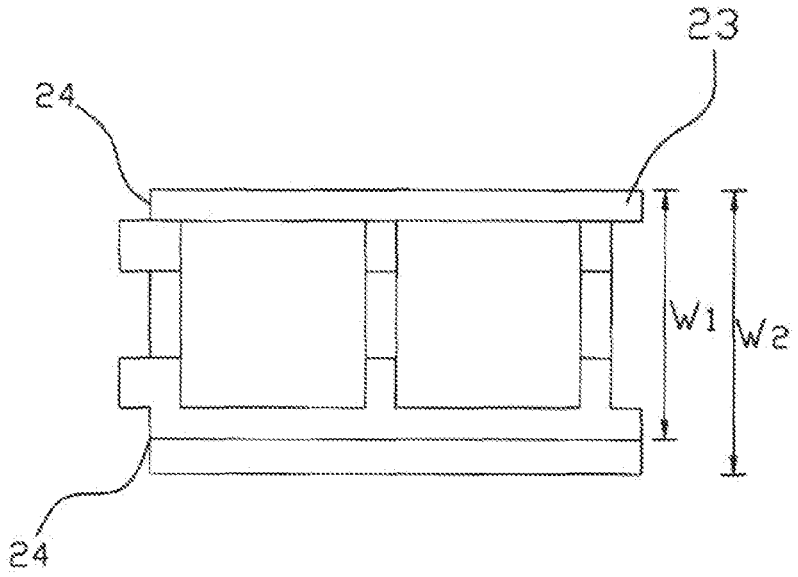
Figure 1F:
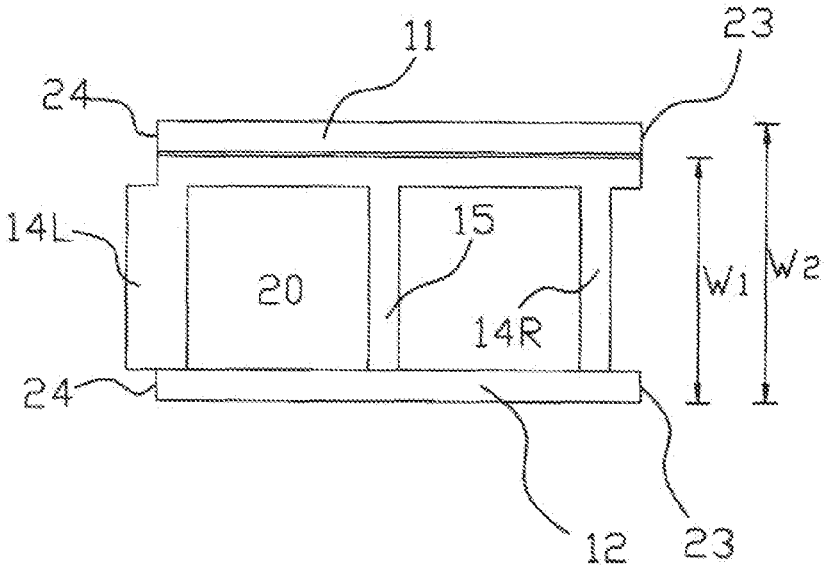
Figure 1G:
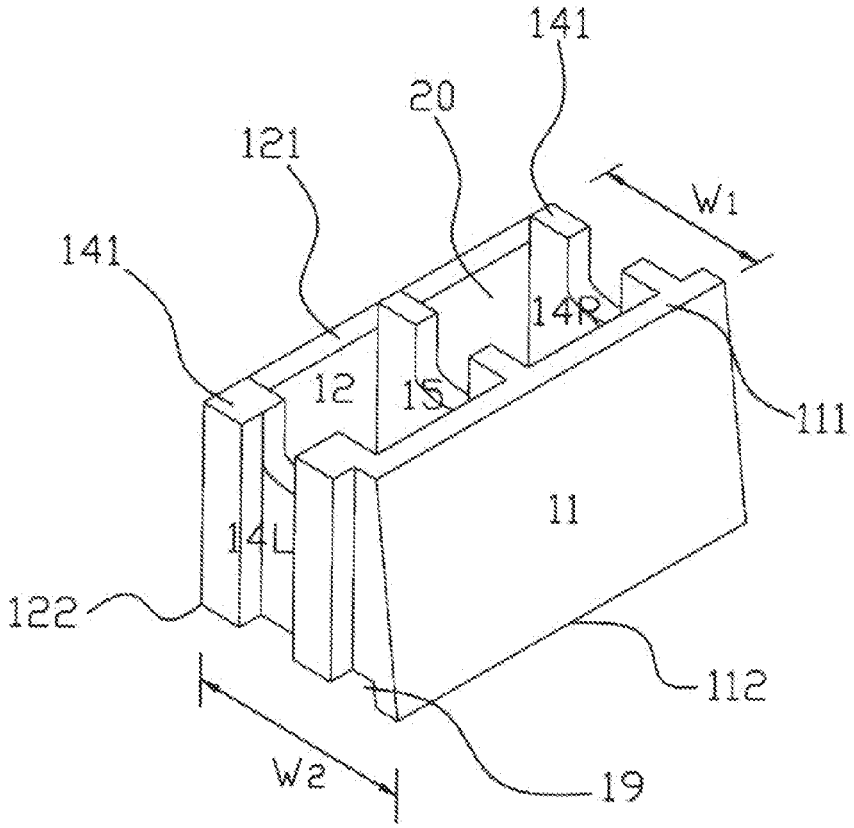
Figure 1H:
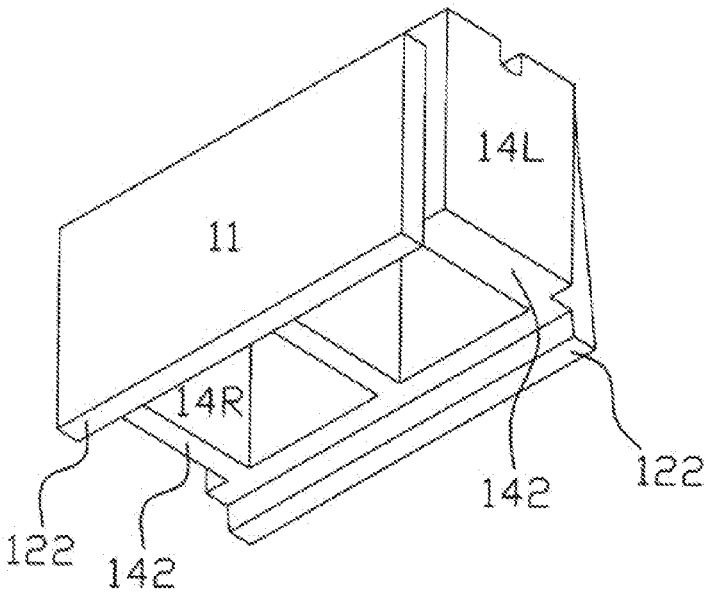
Figure 2A:
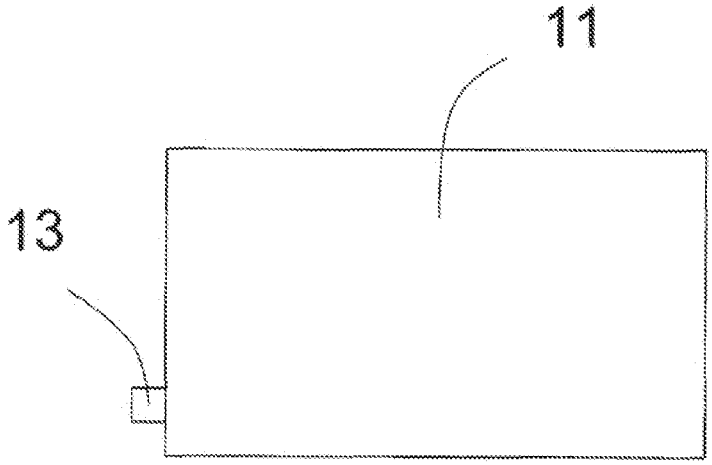
FIG. 2A, FIG. 2B, FIG. 2C, FIG. 2D, FIG. 2E, FIG. 2F, FIG. 2G and FIG. 2H shows the front view (A), back view (B), left view (C), right view (D), top view (E), bottom view (F), front perspective view (G), and bottom perspective view (H) of the second embodiment of the concrete block of the present invention (bond beam block) which is used in a wall on top of a door or an entry.
Figure 2B:
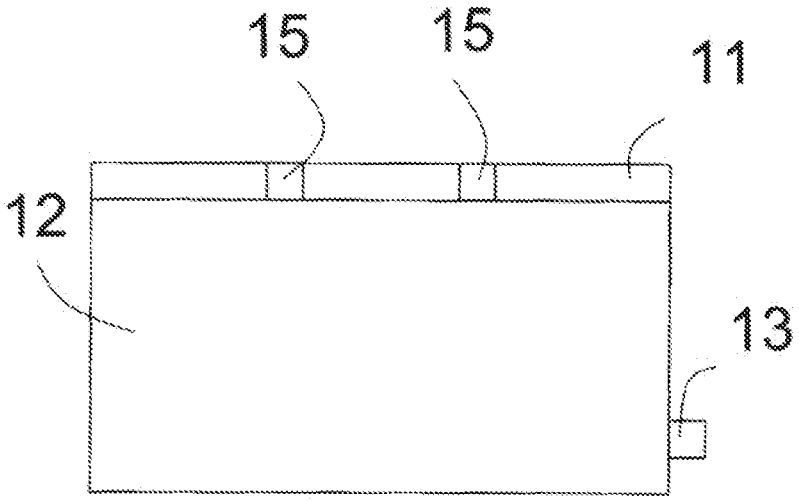
Figure 2C:
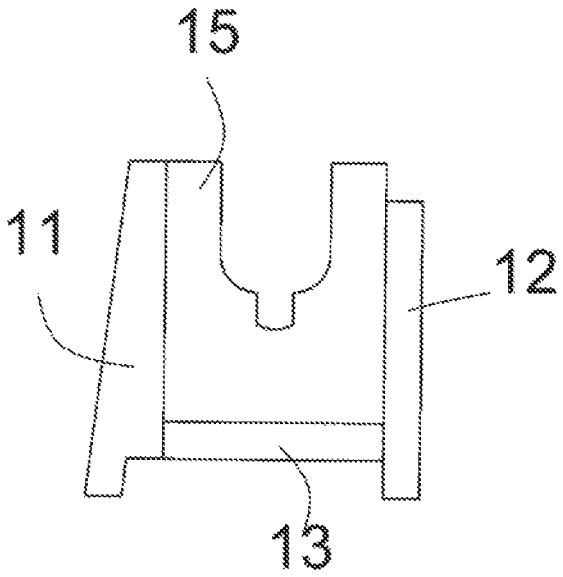
Figure 2D:
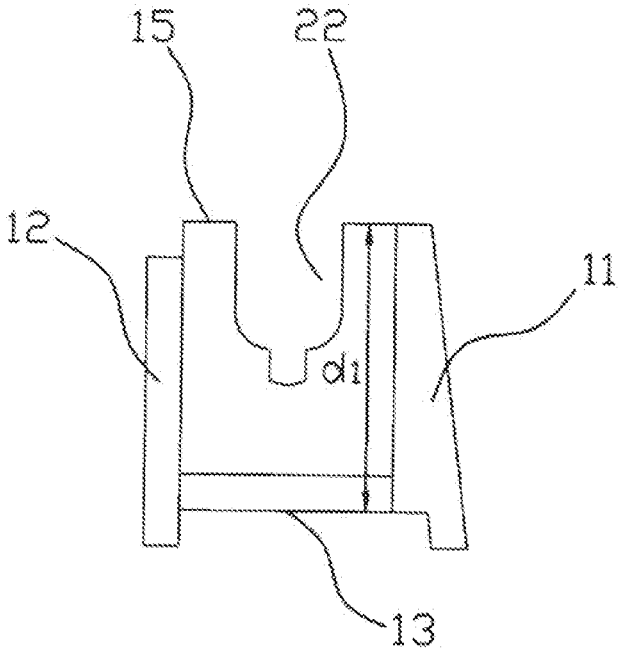
Figure 2E:
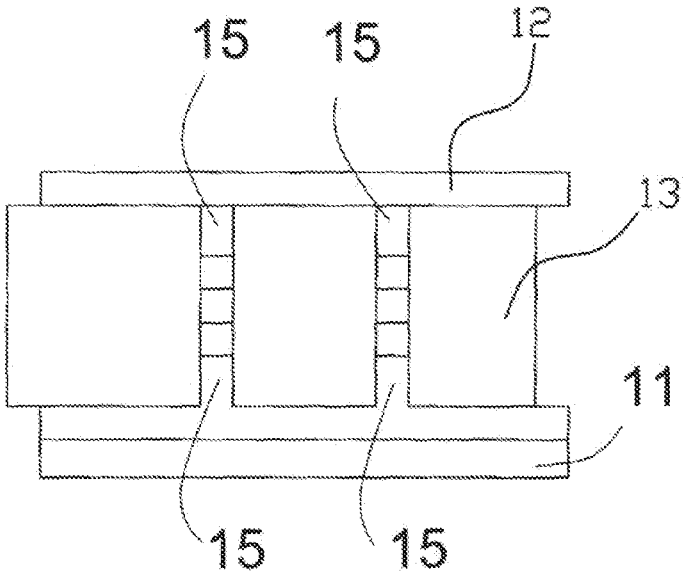
Figure 2F:
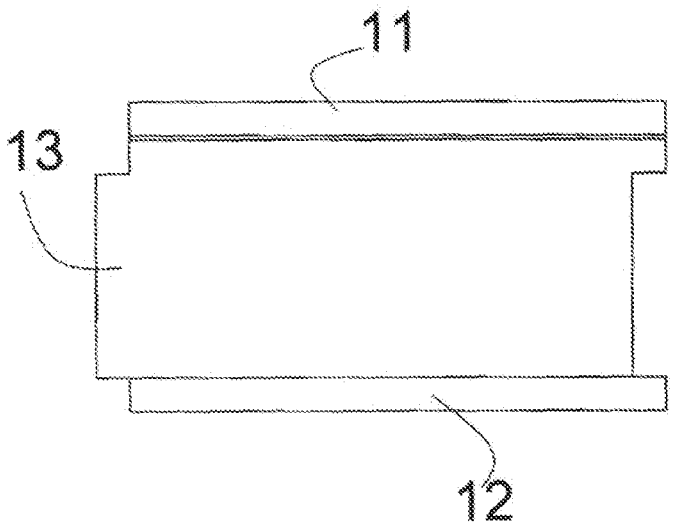
Figure 2G:
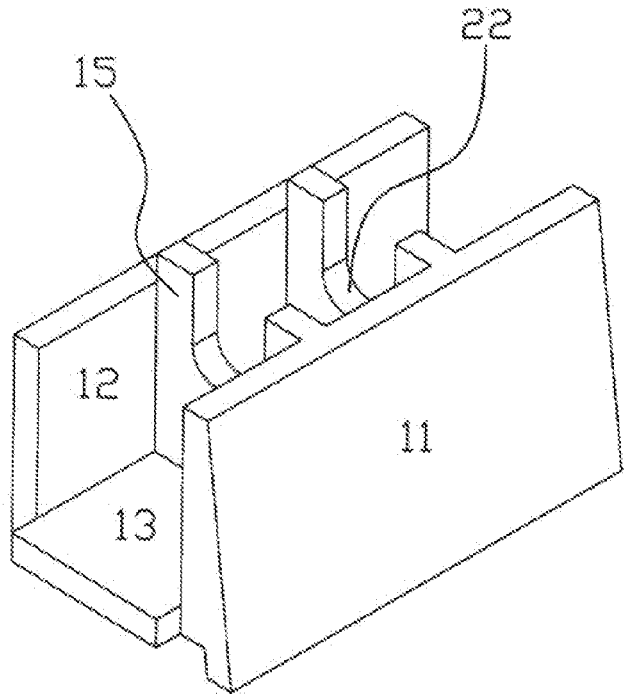
Figure 2H:
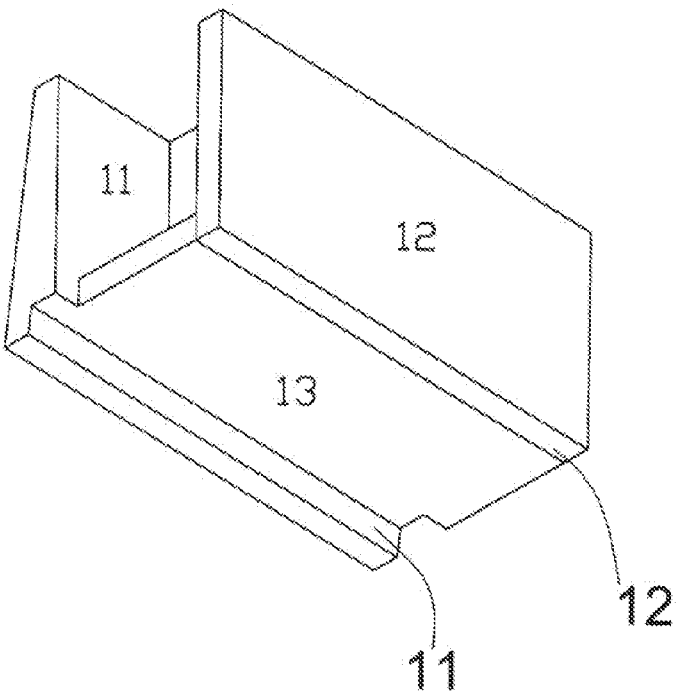
Figure 3A:
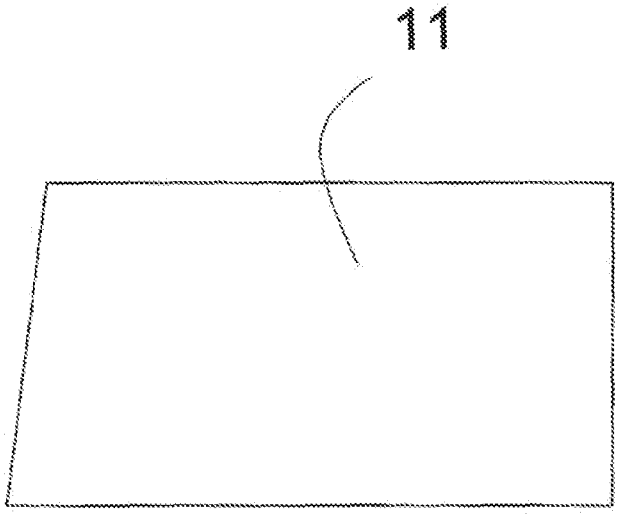
FIG. 3A, FIG. 3B, FIG. 3C, FIG. 3D, FIG. 3E, FIG. 3F, FIG. 3G, and FIG. 3H shows the front view (A), back view (B), left view (C), right view (D), top view (E), bottom view (F), front perspective view (G), and bottom perspective view (H) of the third embodiment of the concrete block (right out corner block) which is used to create a corner of a wall.
Figure 3B:
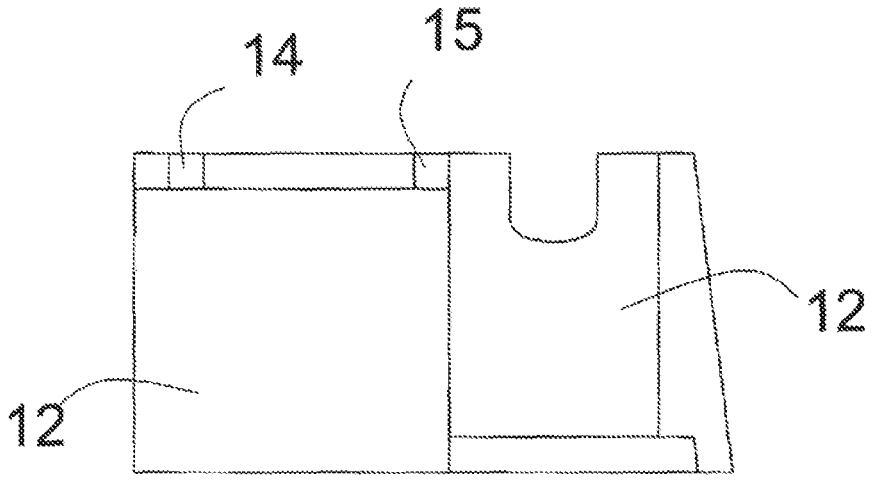
Figure 3C:
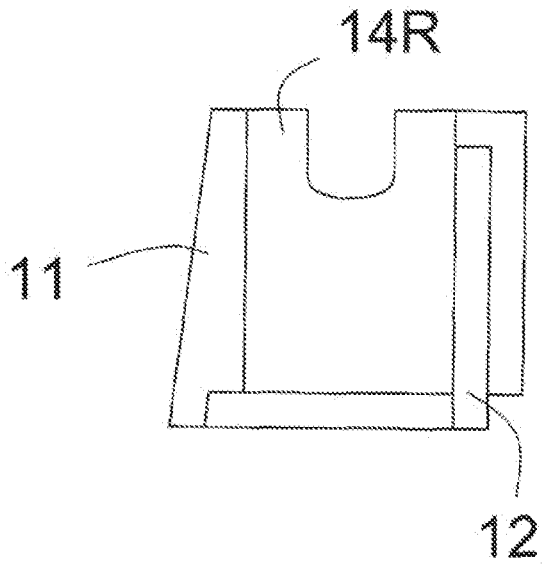
Figure 3D:
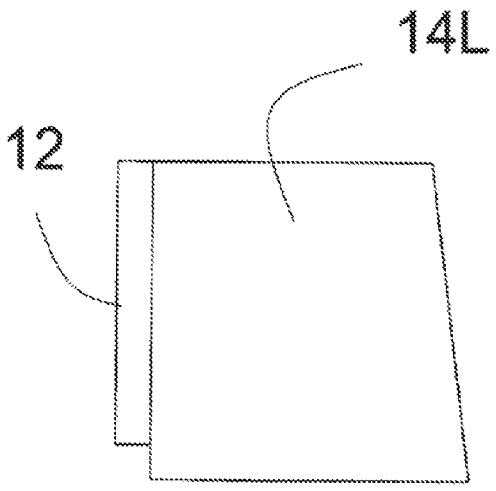
Figure 3E:
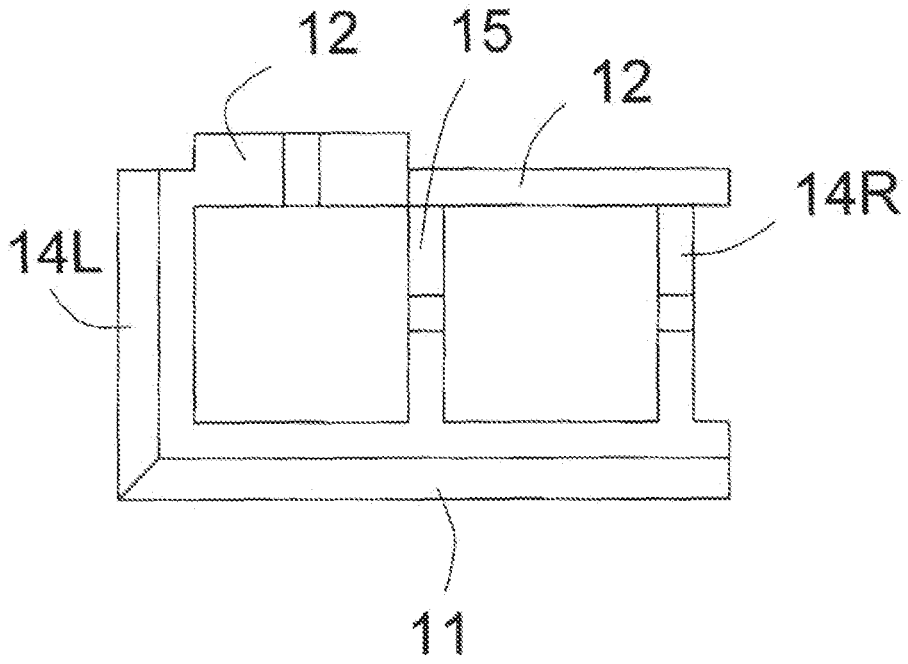
Figure 3F:
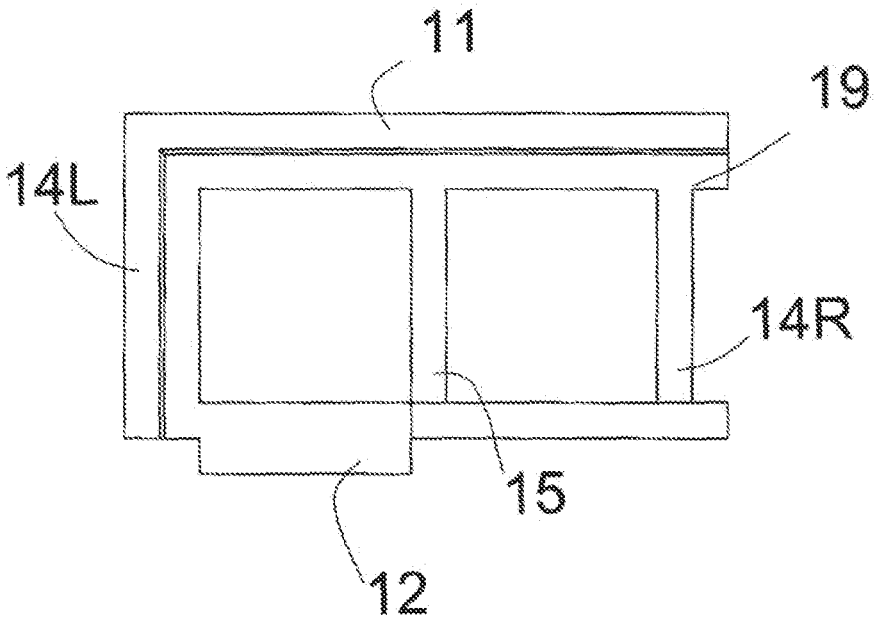
Figure 3G:
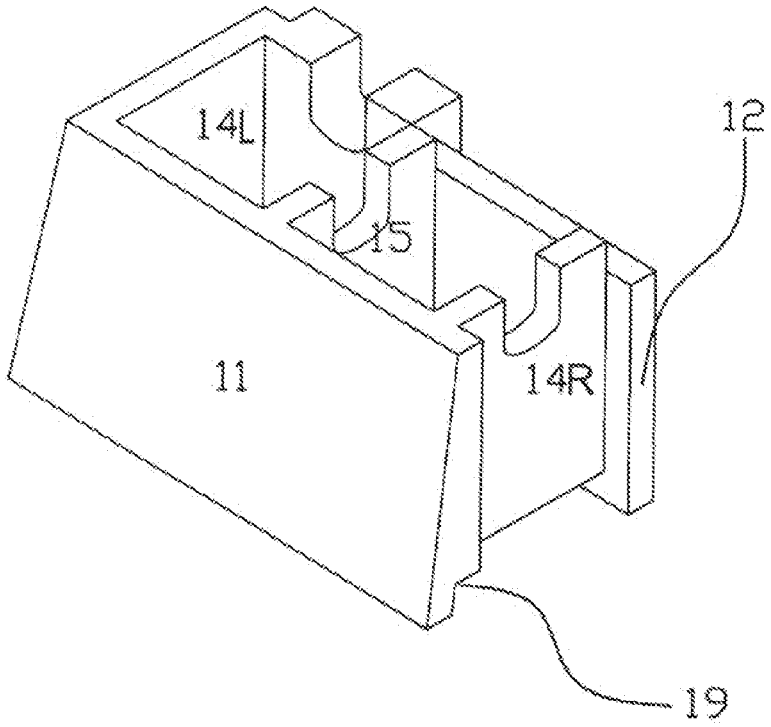
Figure 3H:
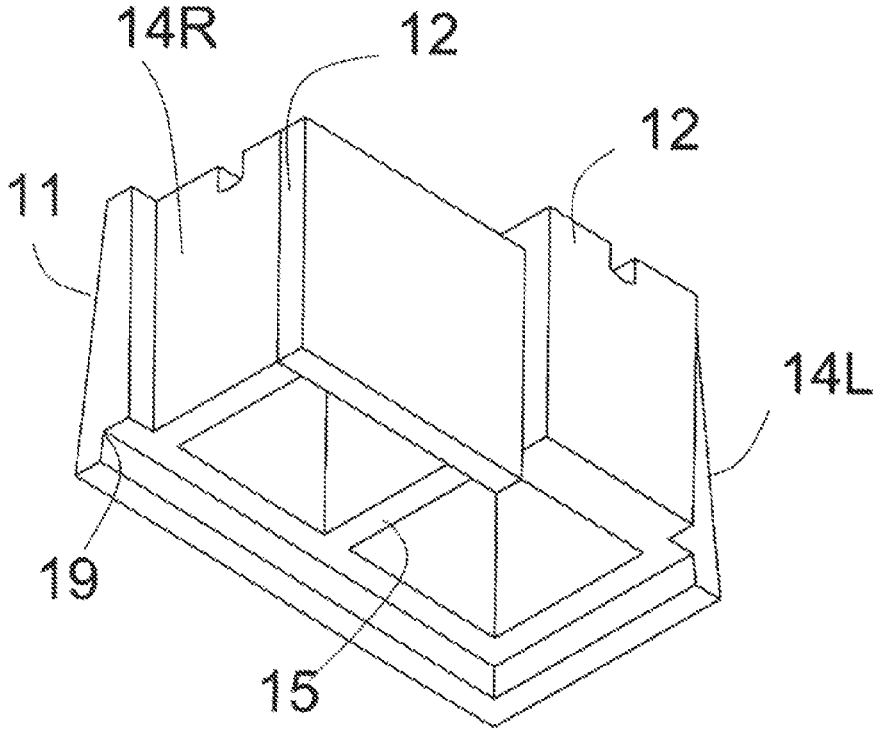
Figure 4A:
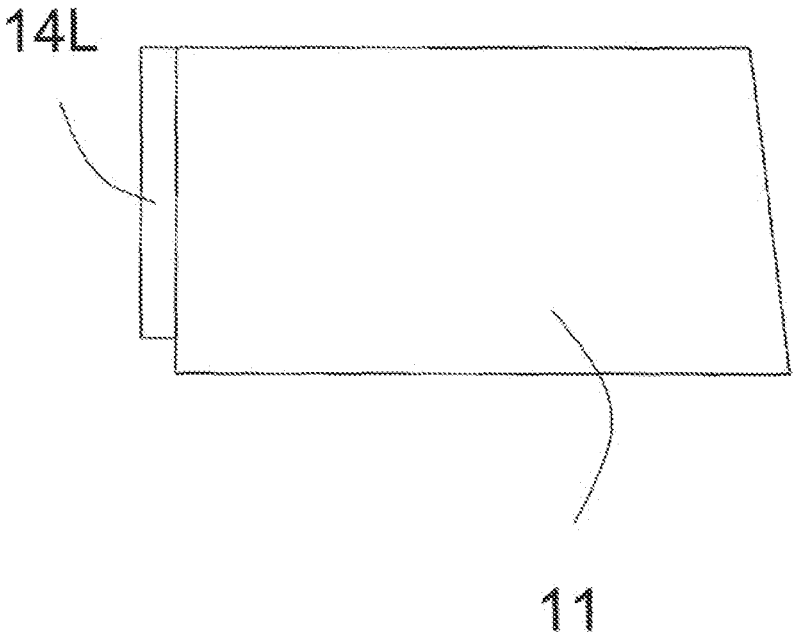
FIG. 4A, FIG. 4B, FIG. 4C, FIG. 4D, FIG. 4E, FIG. 4F, FIG. 4G, and FIG. 4H shows the front view (A), back view (B), left view (C), right view (D), top view (E), bottom view (F), front perspective view (G), and bottom perspective view (H) of the fourth embodiment of the concrete block (left out corner block) which is used to create a corner of a wall.
Figure 4B:
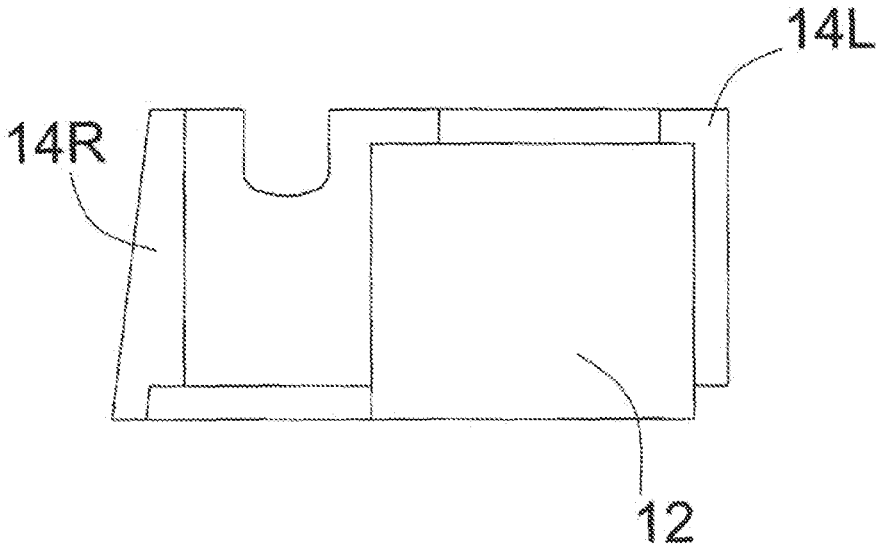
Figure 4C:
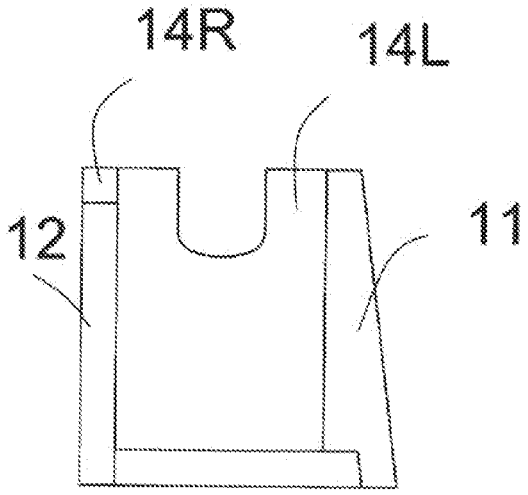
Figure 4D:
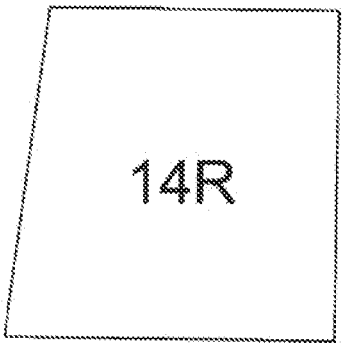
Figure 4E:
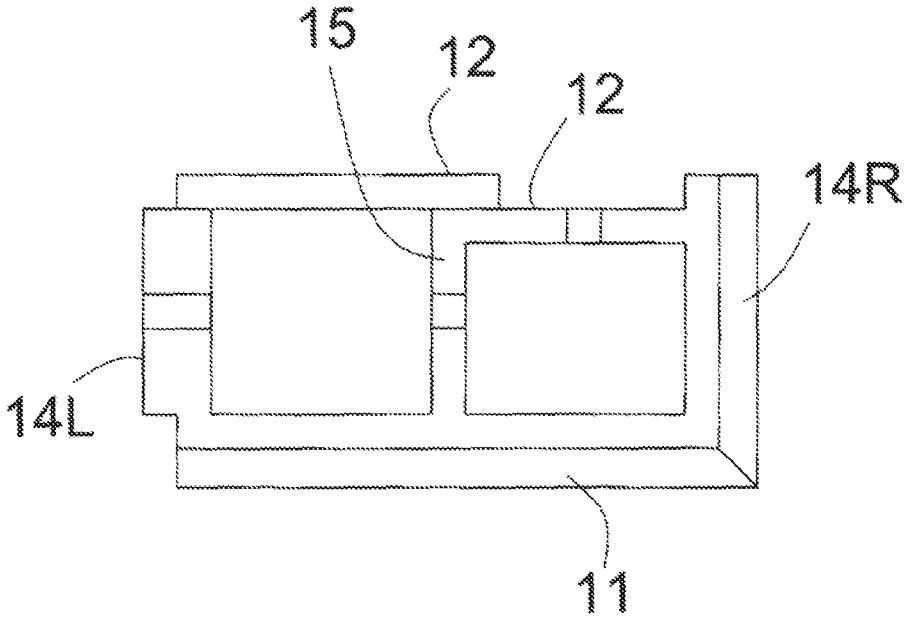
Figure 4F:
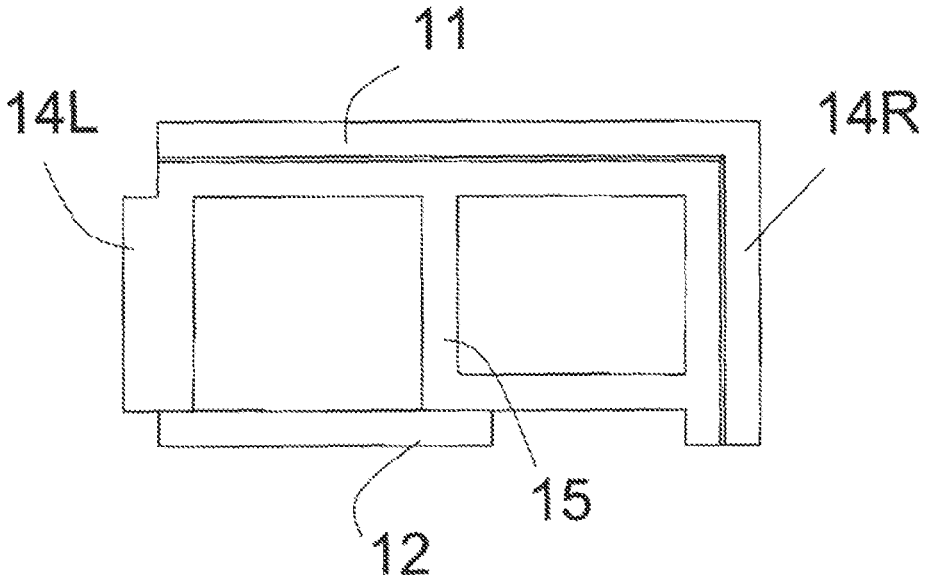
Figure 4G:
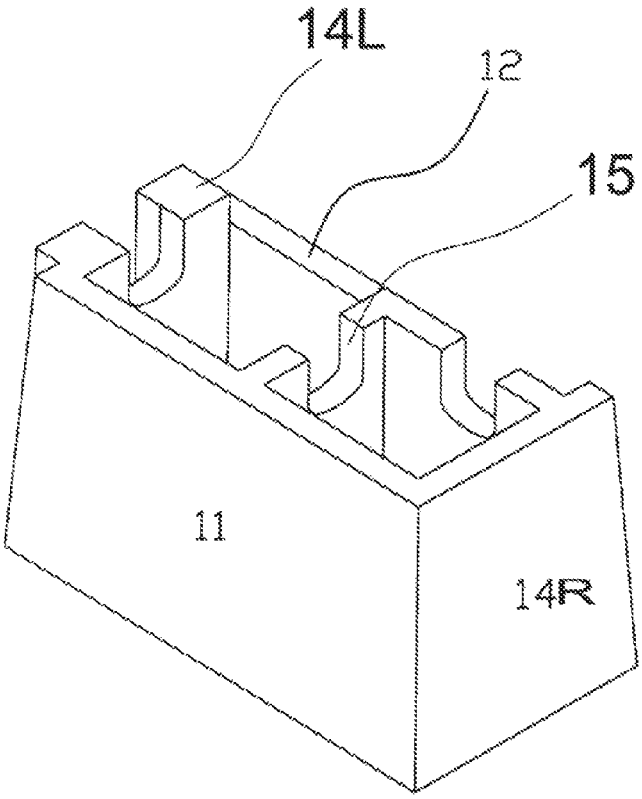
Figure 4H:
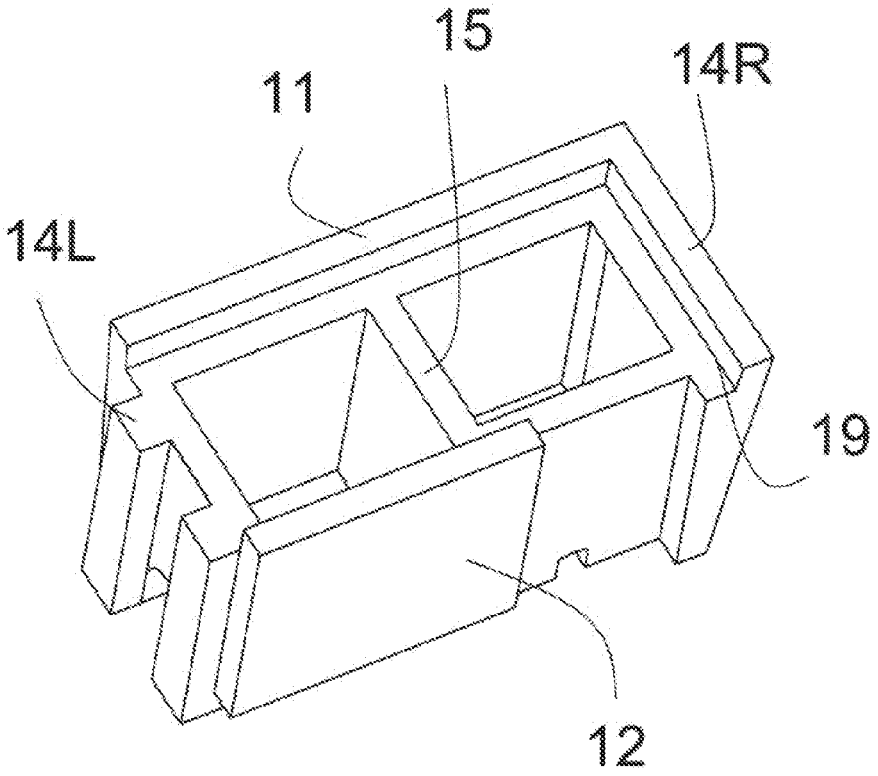
Figure 5A:
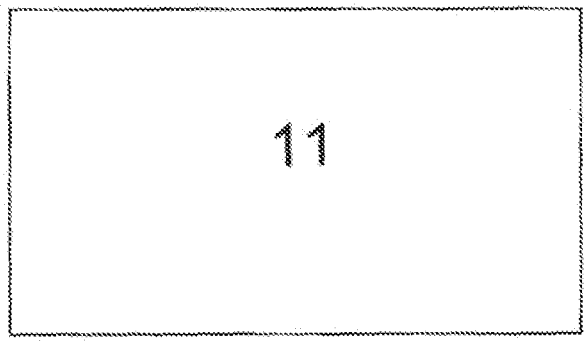
FIG. 5A, FIG. 5B, FIG. 5C, FIG. 5D, FIG. 5E, FIG. 5F, FIG. 5G, and FIG. 5H shows the front view (A), back view (B), left view (C), right view (D), top view (E), bottom view (F), front perspective view (G), and bottom perspective view (H) of the fifth embodiment (right flush) of the concrete block (right flush block) which is used on a wall along the right side of a door.
Figure 5B:
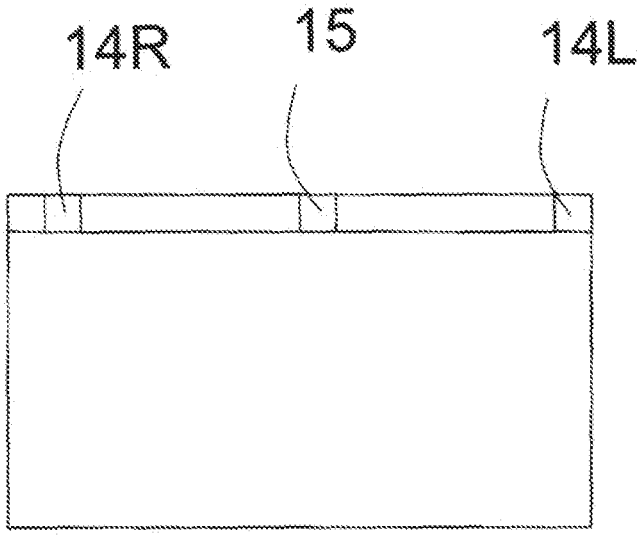
Figure 5C:
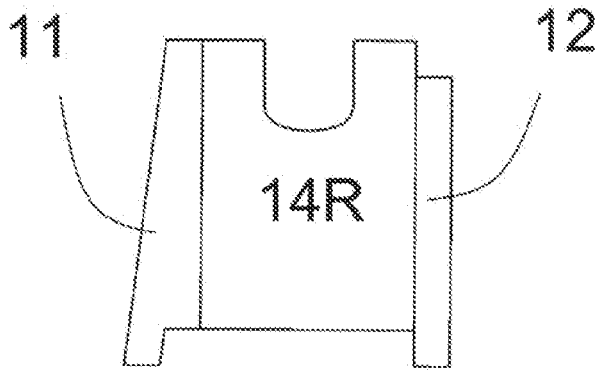
Figure 5D:
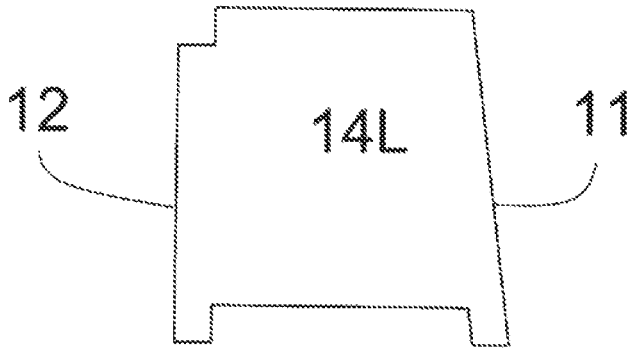
Figure 5E:
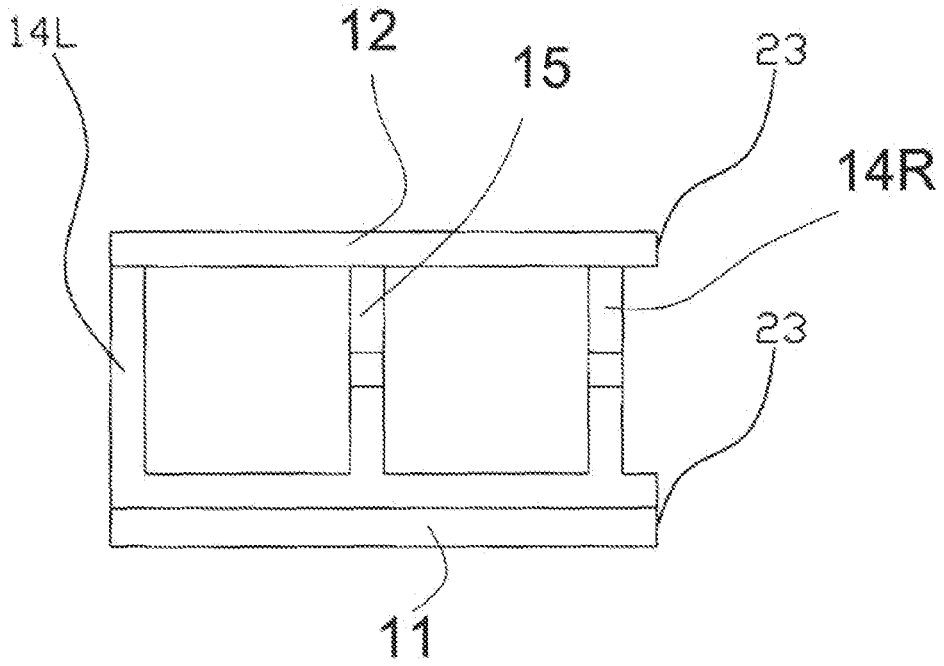
Figure 5F:
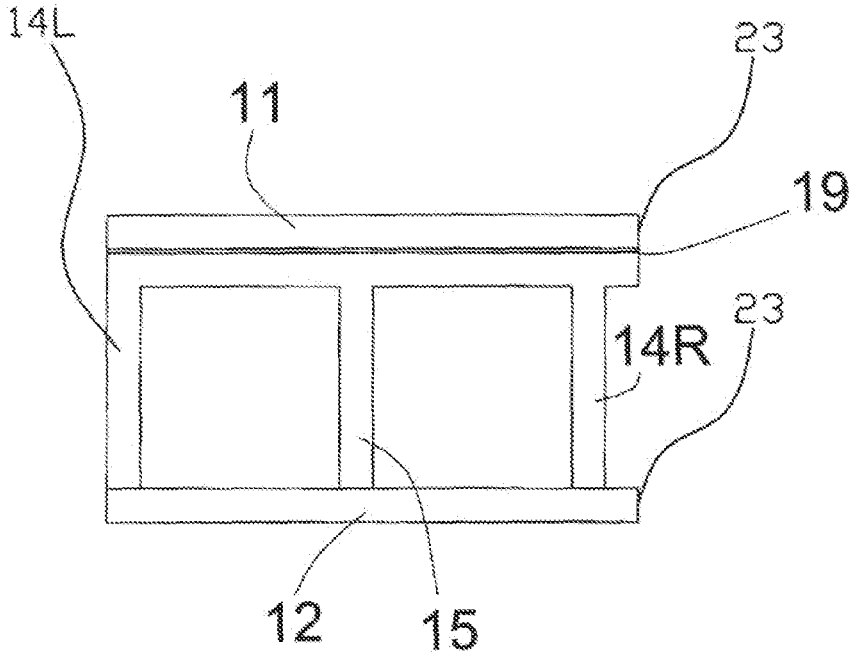
Figure 5G:
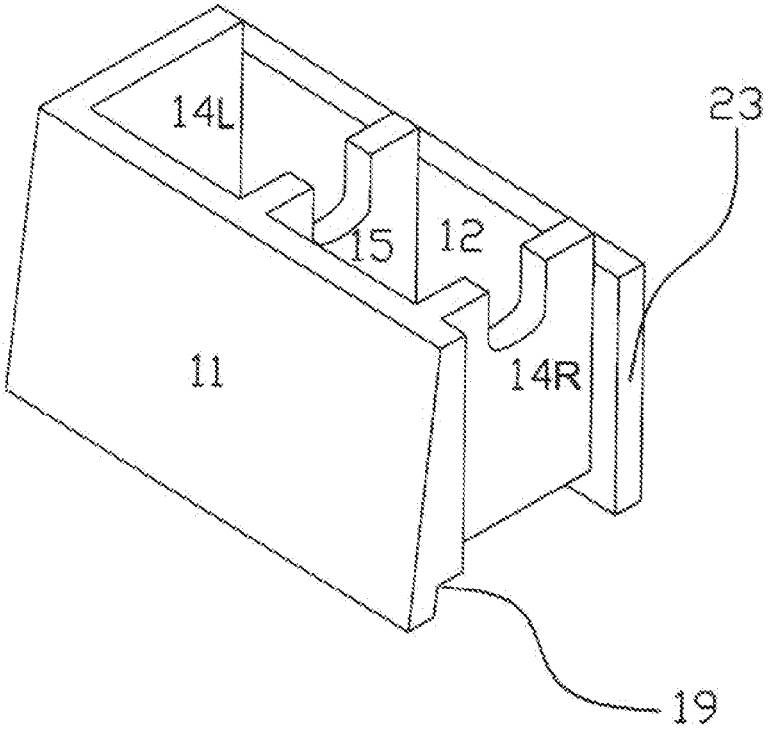
Figure 5H:
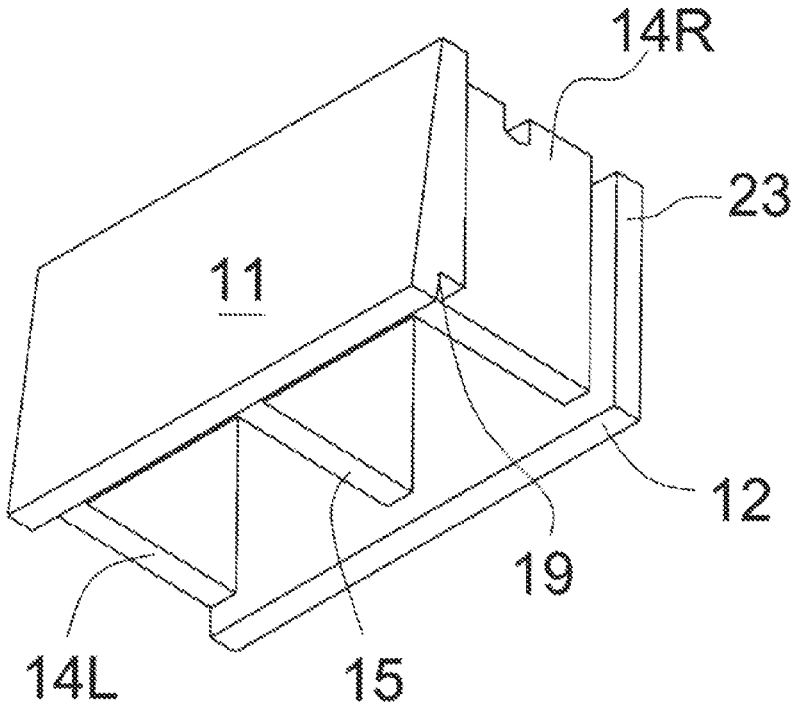
Figure 6A:
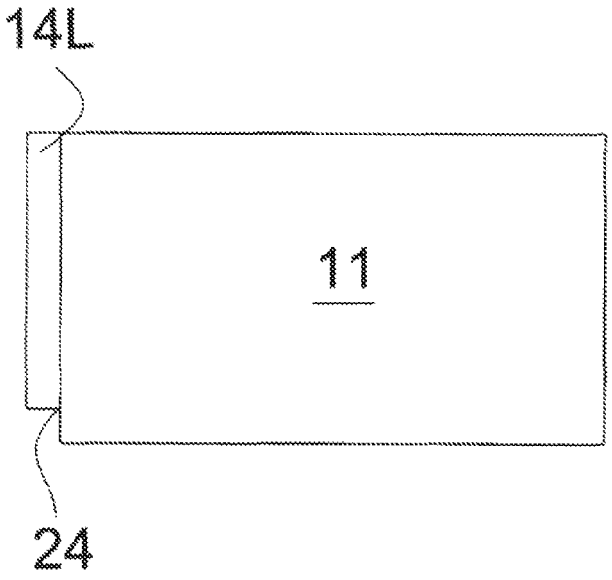
FIG. 6A, FIG. 6B, FIG. 6C, FIG. 6D, FIG. 6E, FIG. 6F, FIG. 6G, and FIG. 6H shows the front view (A), back view (B), left view (C), right view (D), top view (E), bottom view (F), front perspective view (G), and bottom perspective view (H) of the sixth embodiment (left flush) of the concrete block (left flush block) which is to be used on a wall along the left side of a door.
Figure 6B:
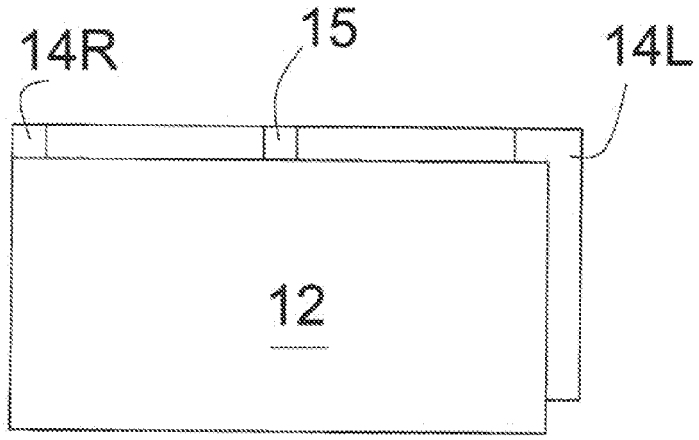
Figure 6C:
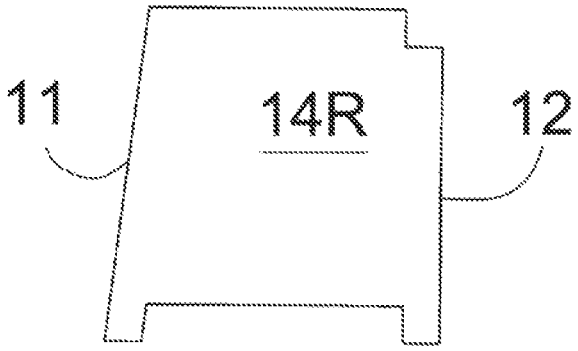
Figure 6D:
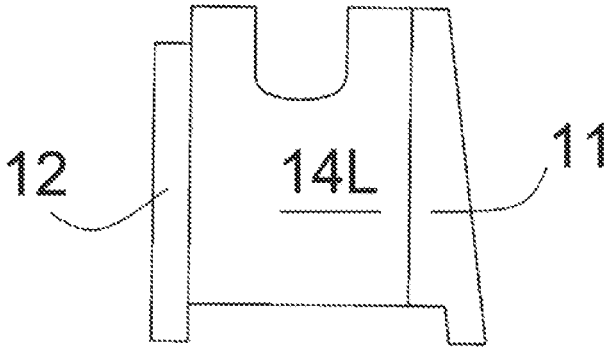
Figure 6E:
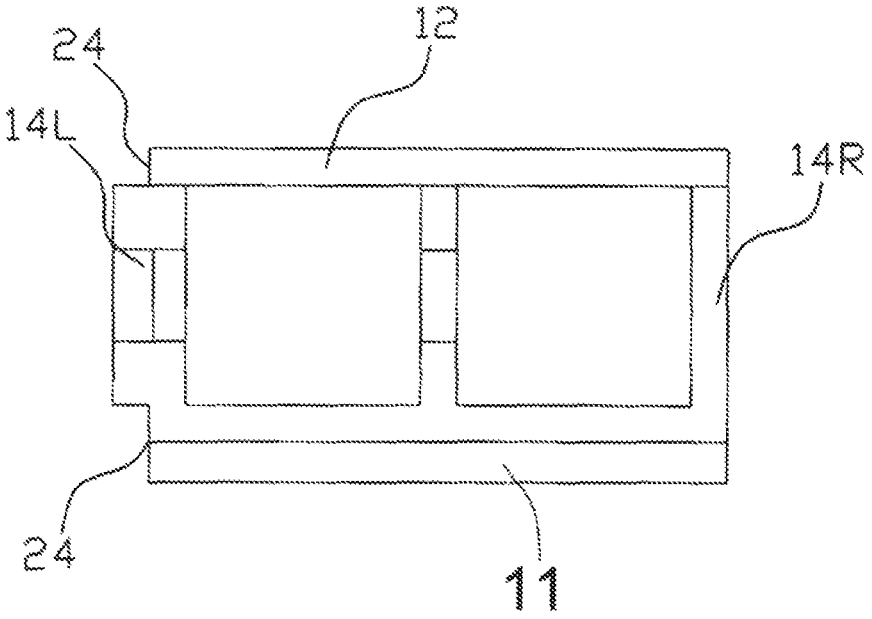
Figure 6F:
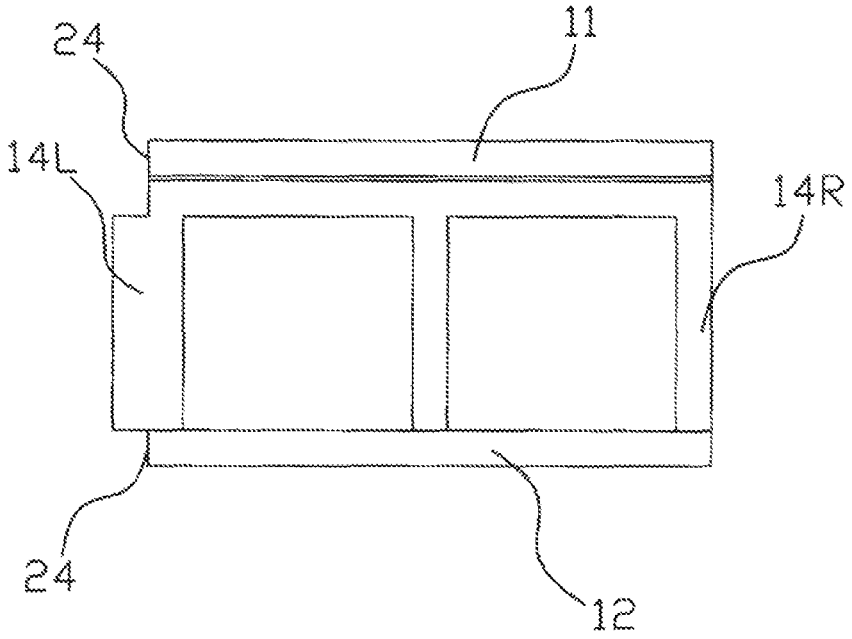
Figure 6G:
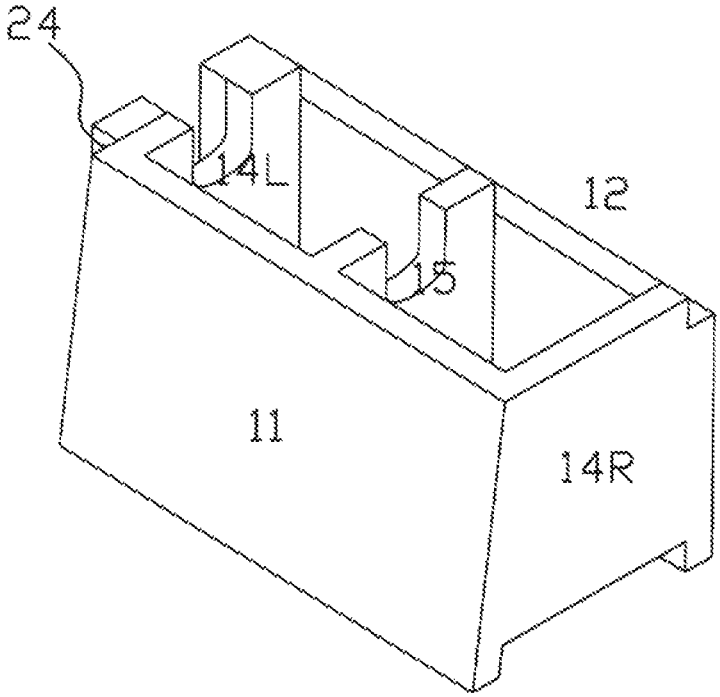
Figure 6H:
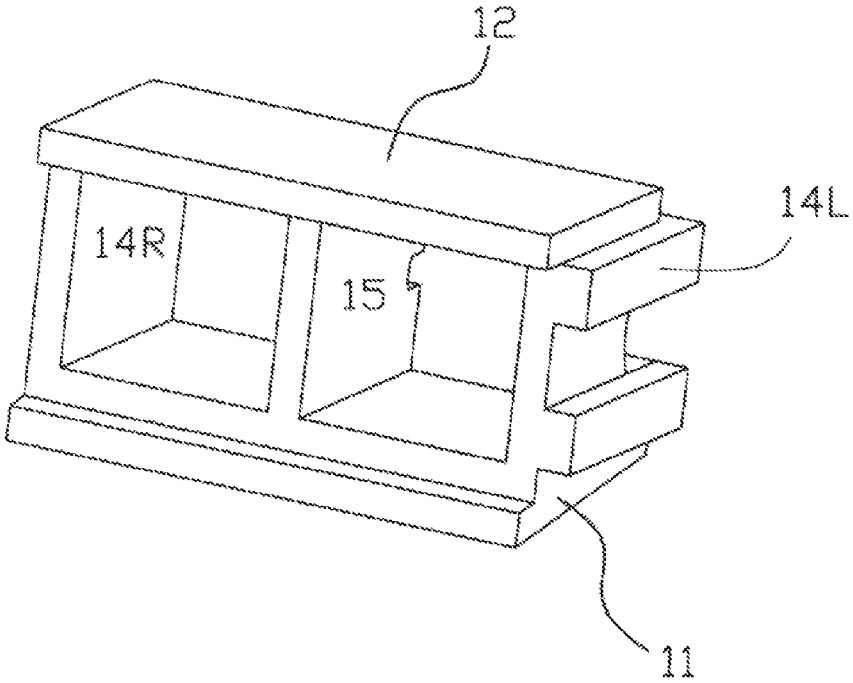
Figure 7A:
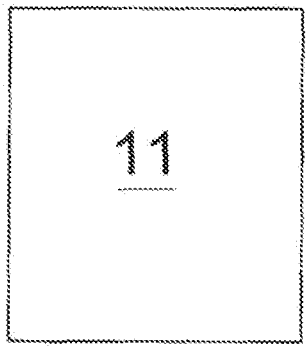
FIG. 7A, FIG. 7B, FIG. 7C, FIG. 7D, FIG. 7E, FIG. 7F, FIG. 7G, and FIG. 7H shows the front view (A), back view (B), left view (C), right view (D), top view (E), bottom view (F), front perspective view (G), and bottom perspective view (H) of the seventh embodiments (right half flush) of the concrete block (right half flush block) which is also used on a wall along the right side of a door.
Figure 7B:
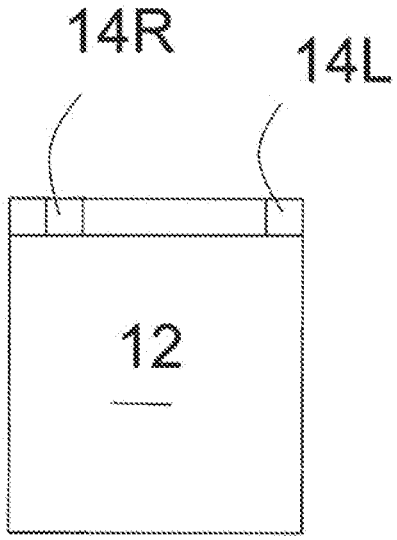
Figure 7C:
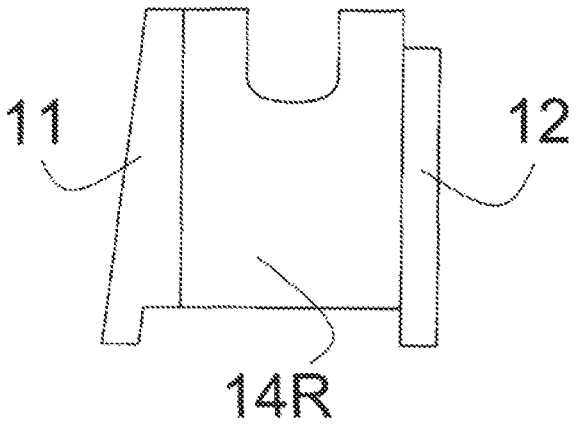
Figure 7D:
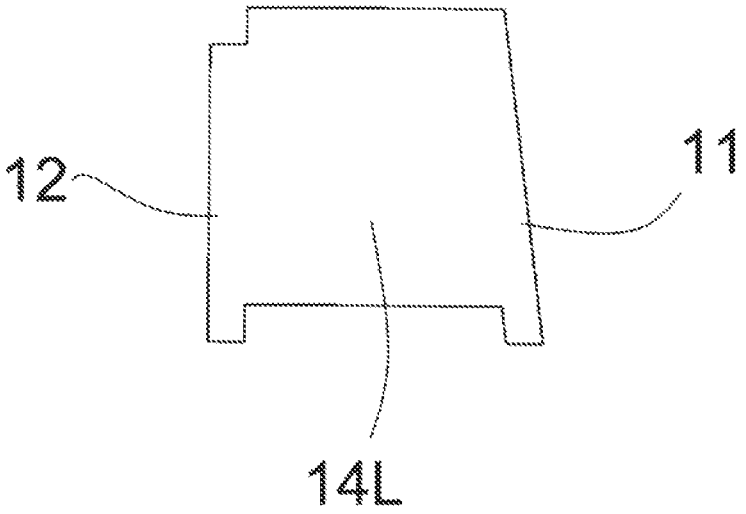
Figure 7E:
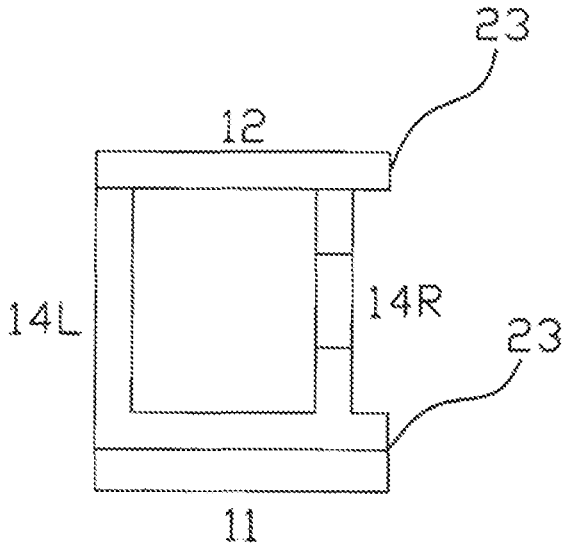
Figure 7F:
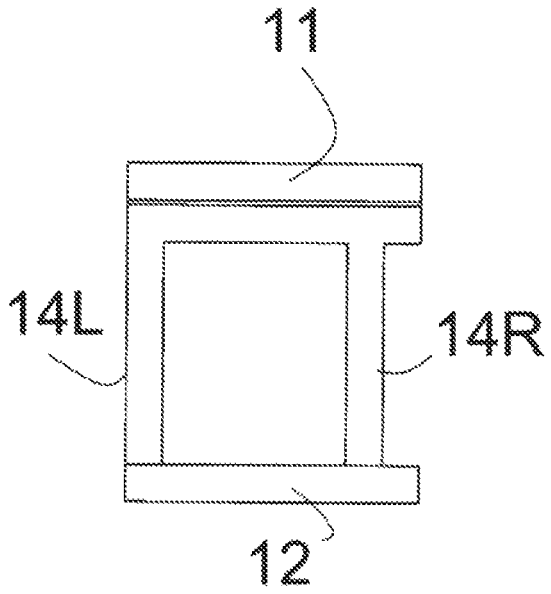
Figure 7G:
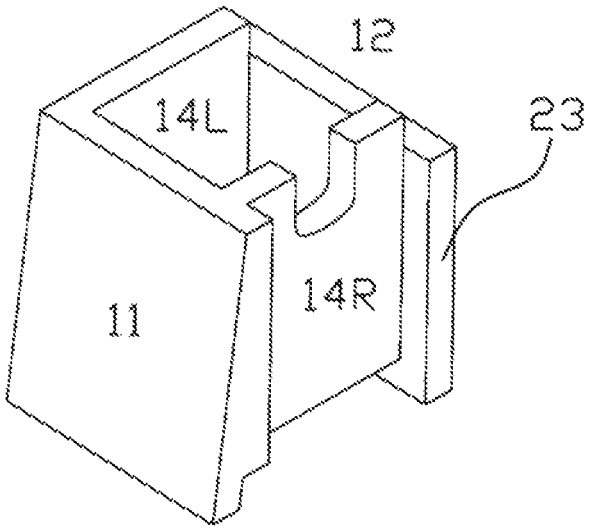
Figure 7H:
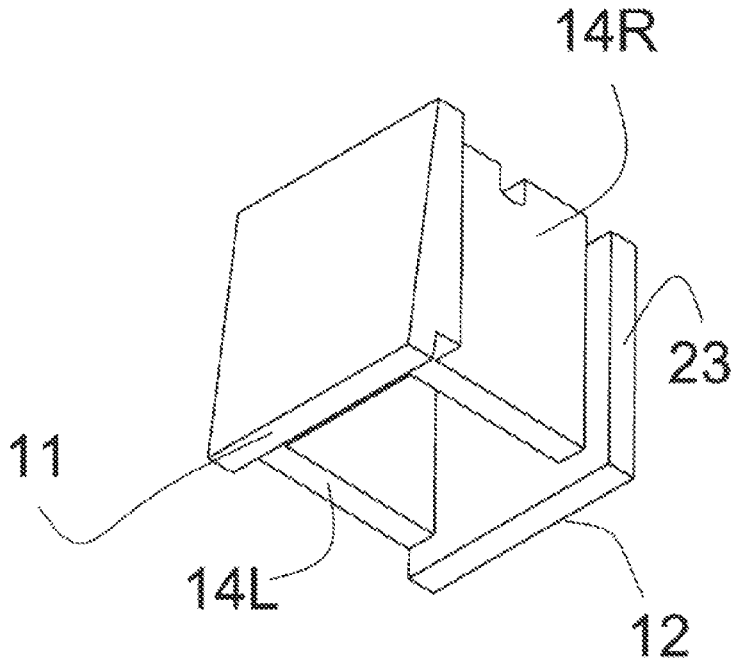
Figure 8A:
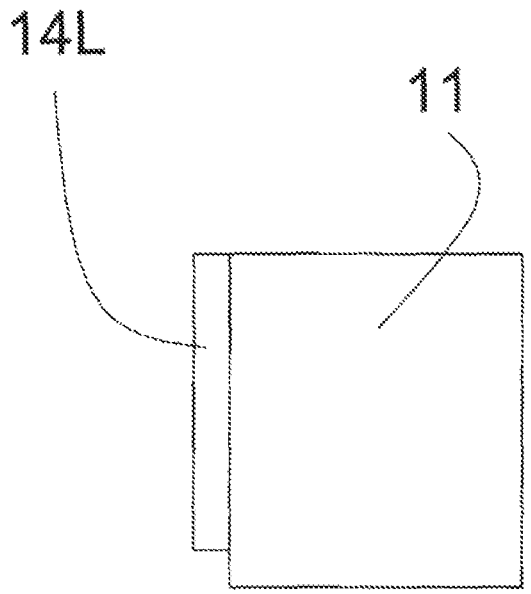
FIG. 8A, FIG. 8B, FIG. 8C, FIG. 8D, FIG. 8E, FIG. 8F, FIG. 8G, and FIG. 8H shows the front view (A), back view (B), left view (C), right view (D), top view (E), bottom view (F), front perspective view (G), and bottom perspective view (H) of the eighth embodiment (left half flush) of the concrete block (left half flush block) which is also used on a wall along the left side of a door.
Figure 8B:
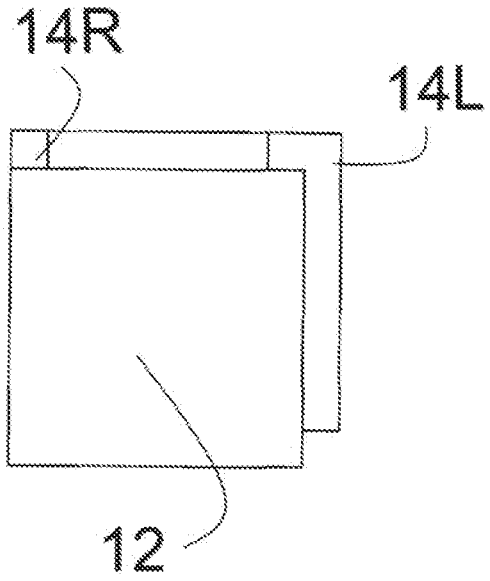
Figure 8C:
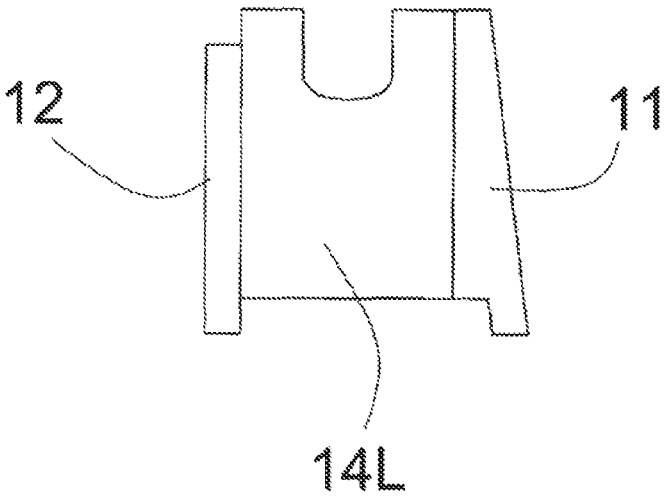
Figure 8D:
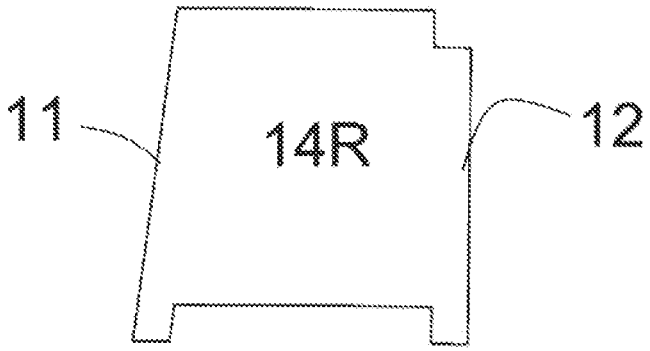
Figure 8E:
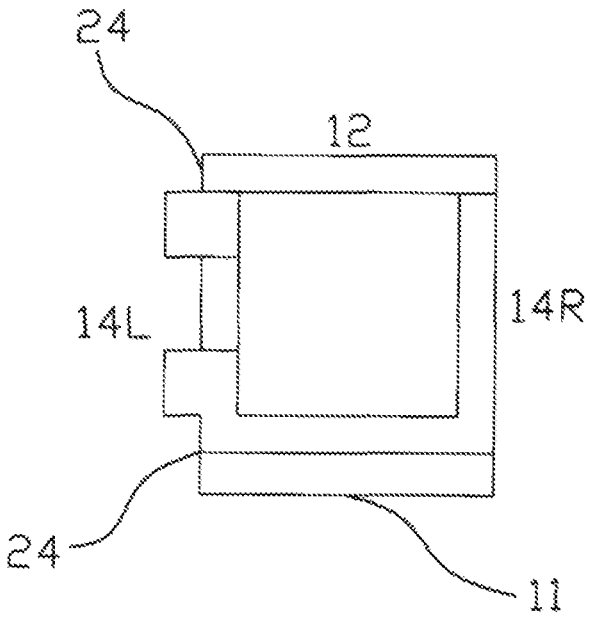
Figure 8F:
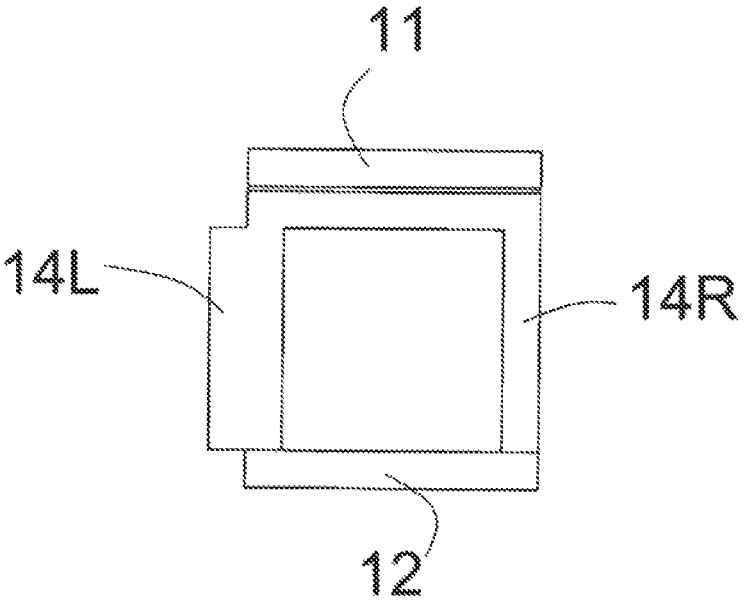
Figure 8G:
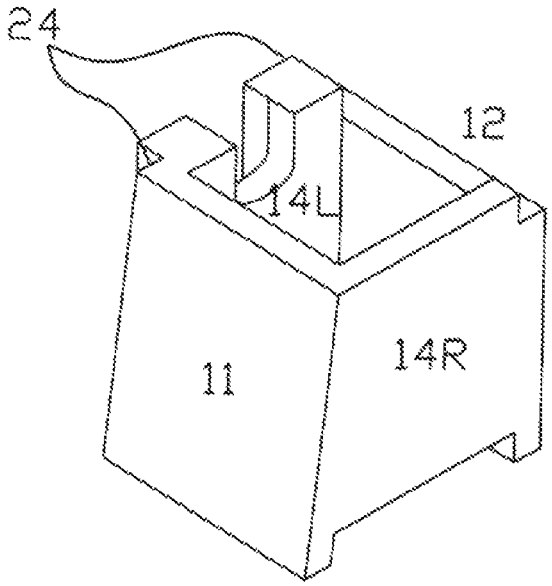
Figure 8H:
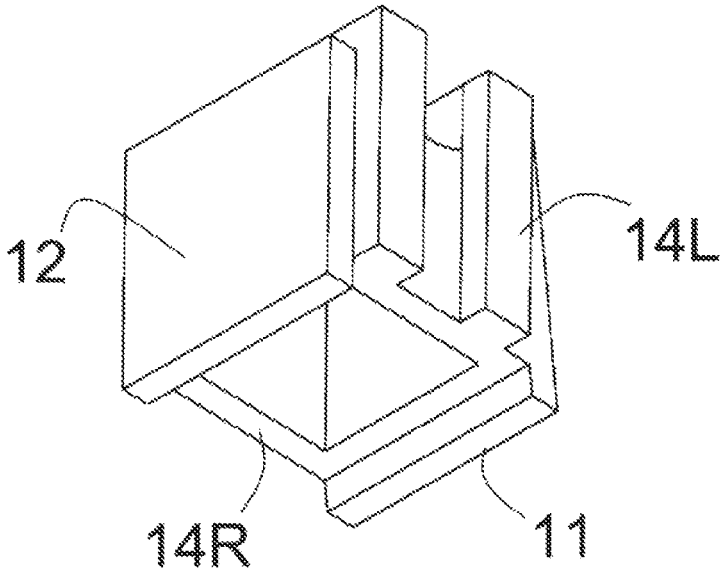
Figure 9A:
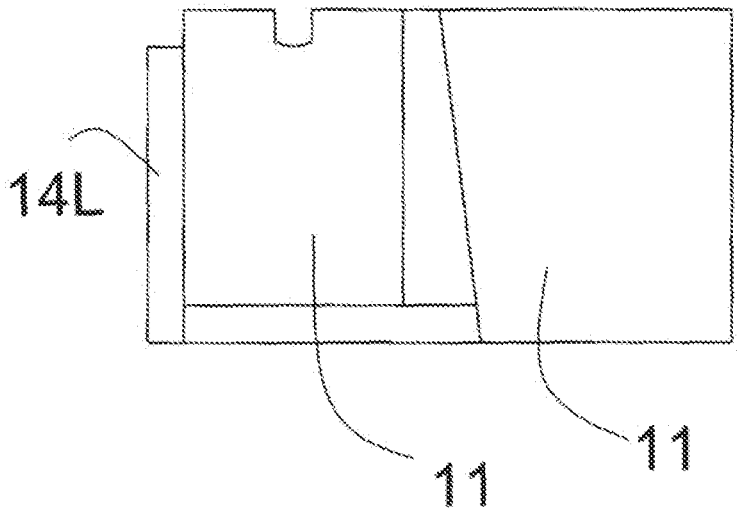
FIG. 9A, FIG. 9B, FIG. 9C, FIG. 9D, FIG. 9E, FIG. 9F, FIG. 9G, and FIG. 9H shows the front view (A), back view (B), left view (C), right view (D), top view (E), bottom view (F), front perspective view (G), and bottom perspective view (H) of the ninth embodiment of the concrete block (left in corner block) which is also used to create a corner of a wall.
Figure 9B:
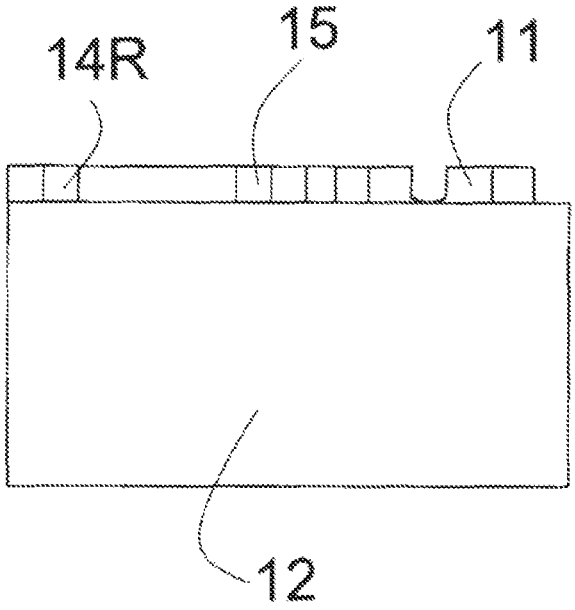
Figure 9C:
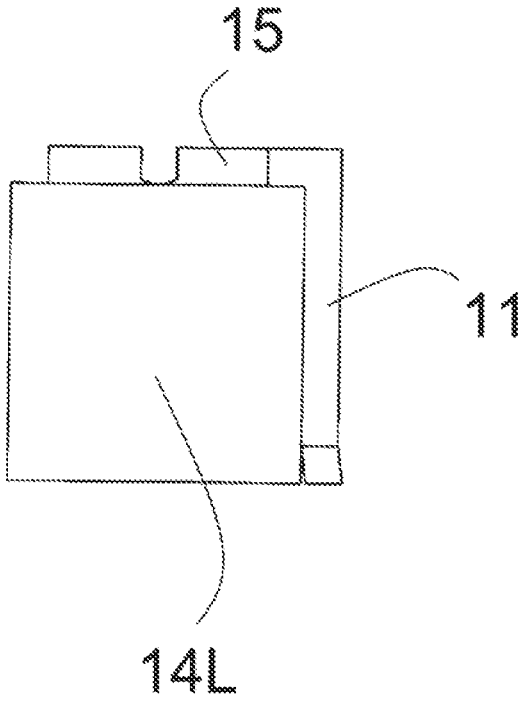
Figure 9D:
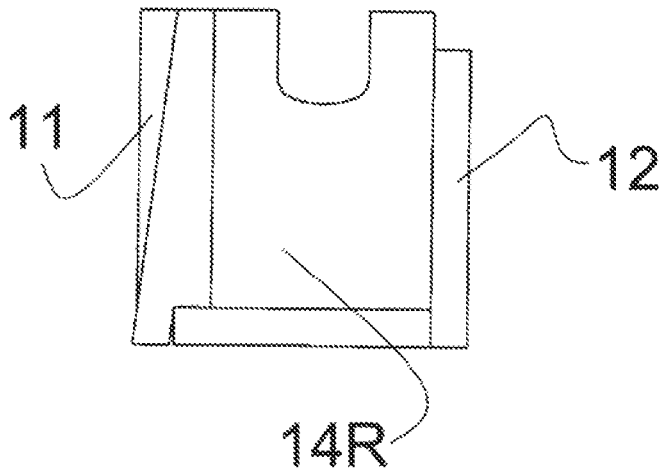
Figure 9E:
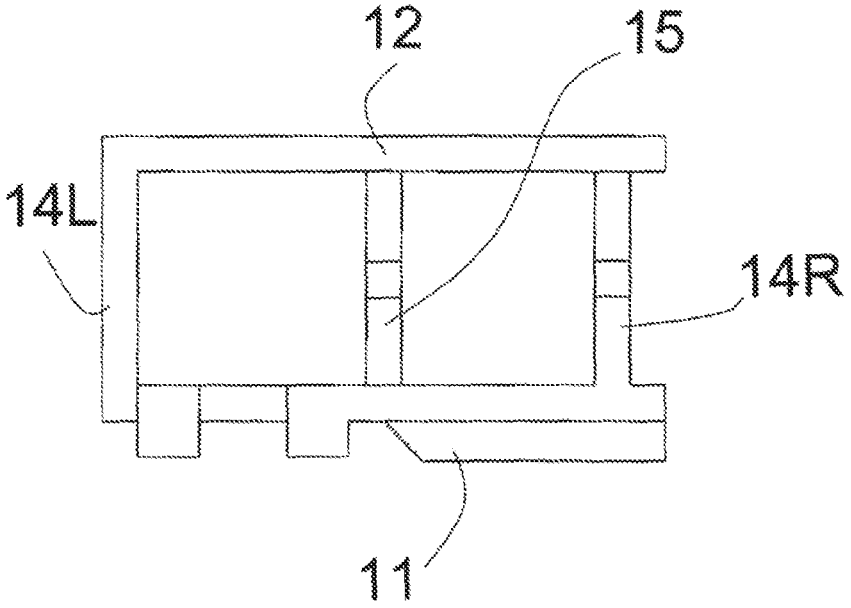
Figure 9F:
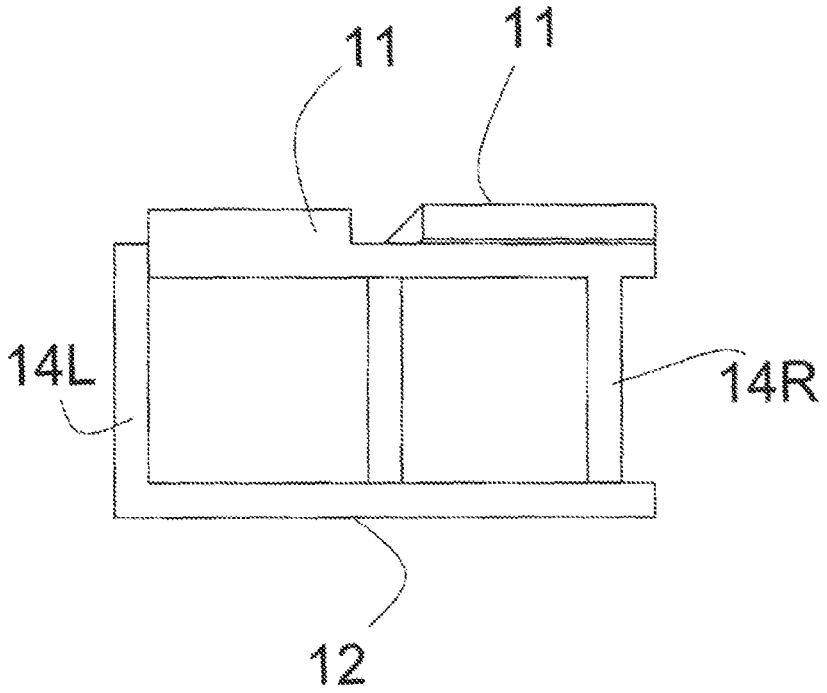
Figure 9G:
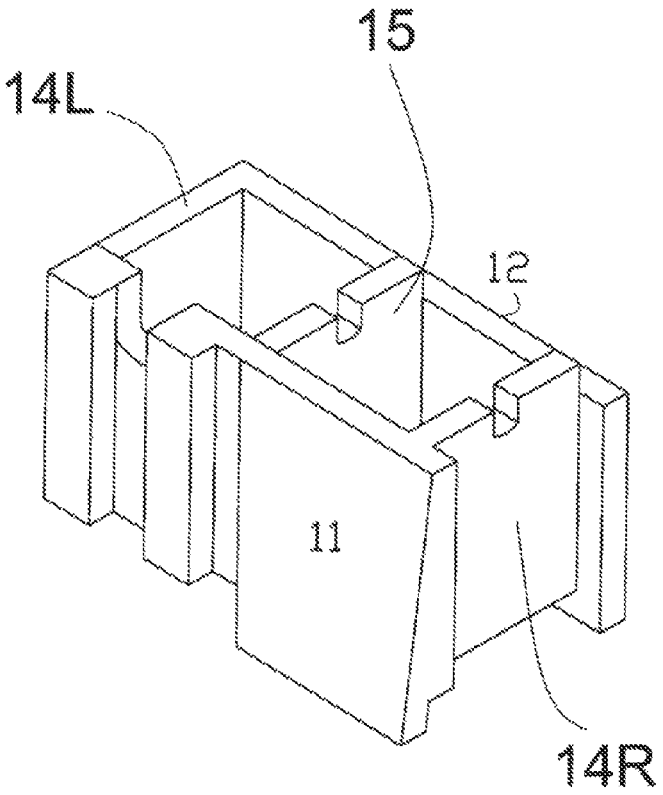
Figure 9H:
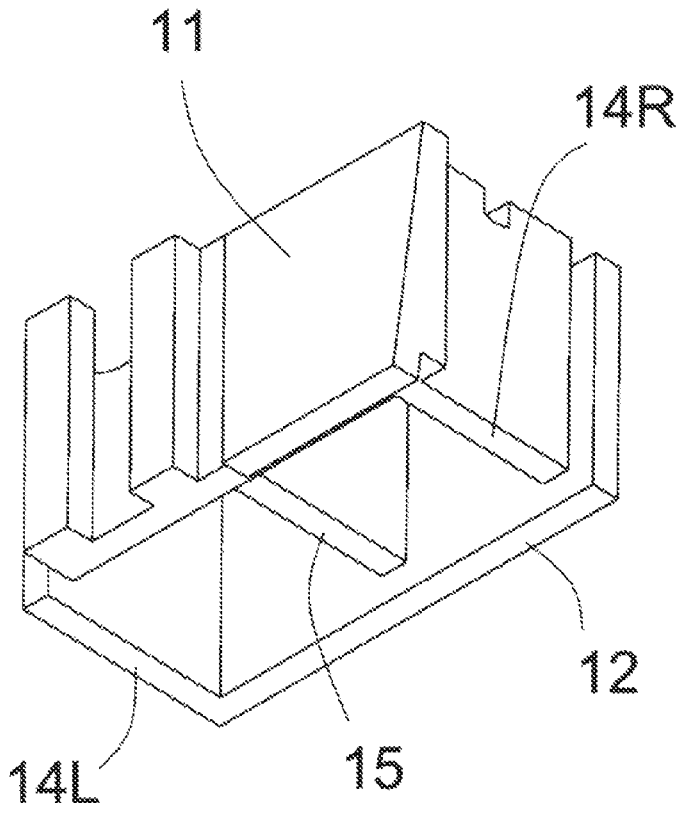
Figure 10A:
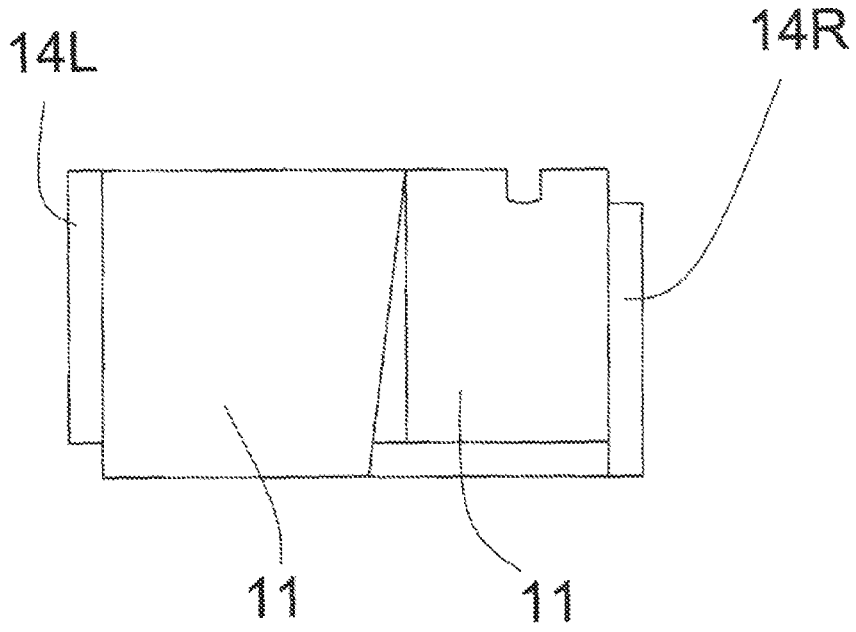
FIG. 10A, FIG. 10B, FIG. 10C, FIG. 10D, FIG. 10E, FIG. 10F, FIG. 10G, and FIG. 10H shows the front view (A), back view (B), left view (C), right view (D), top view (E), bottom view (F), front perspective view (G), and bottom perspective view (H) of the tenth embodiment of the concrete block (right in corner block) which is also used to create a corner of a wall.
Figure 10B:
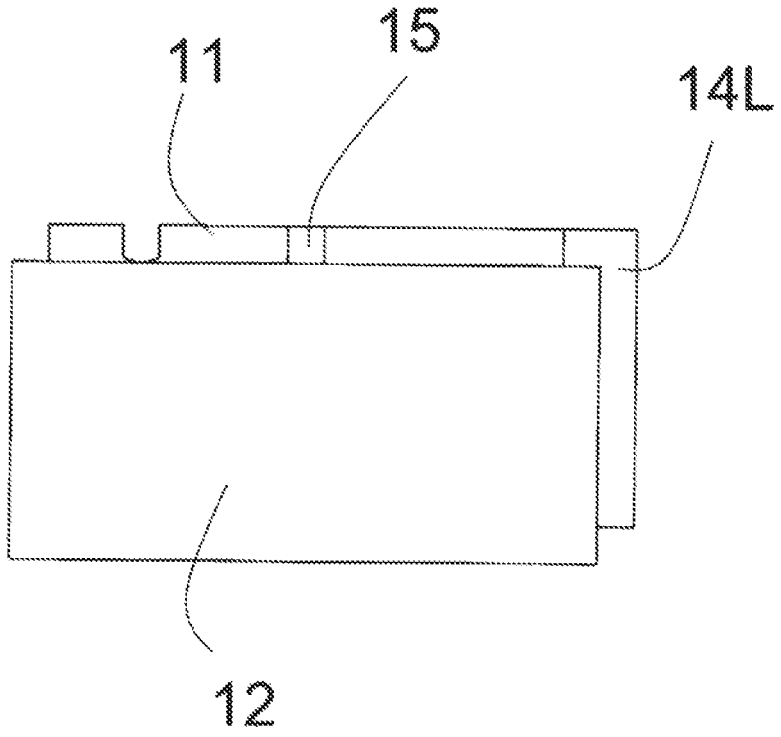
Figure 10C:
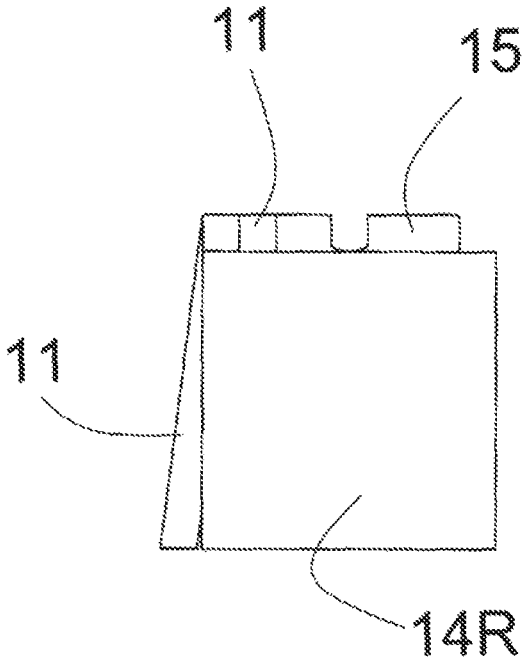
Figure 10D:
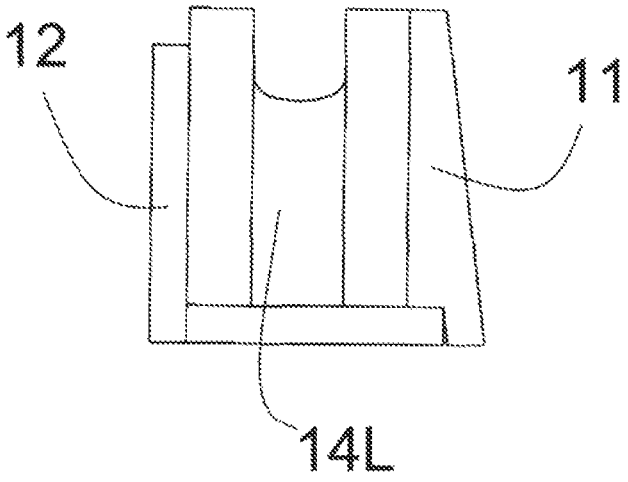
Figure 10E:
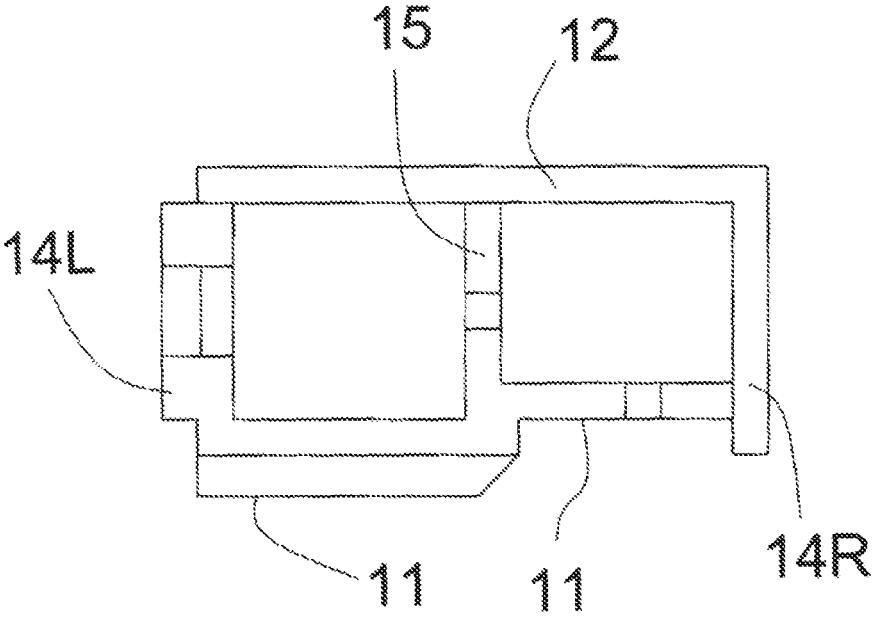
Figure 10F:
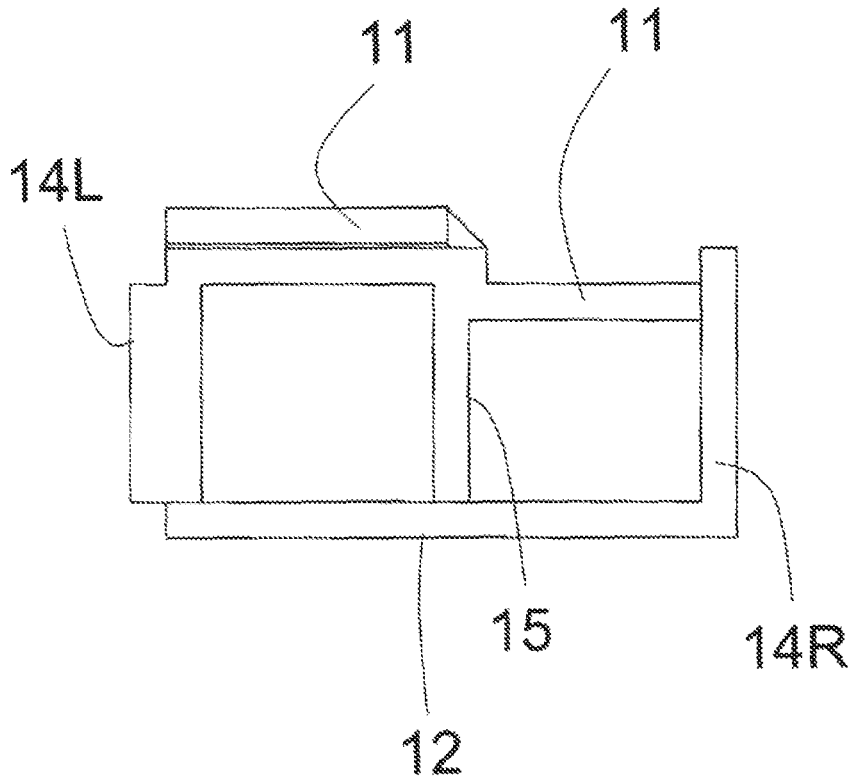
Figure 10G:
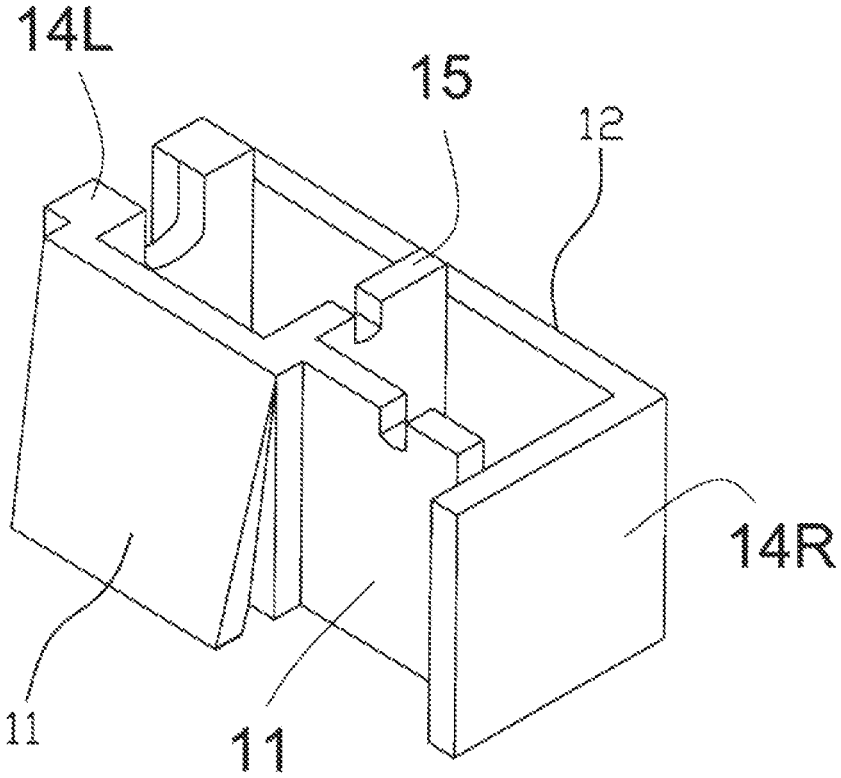
Figure 10H:
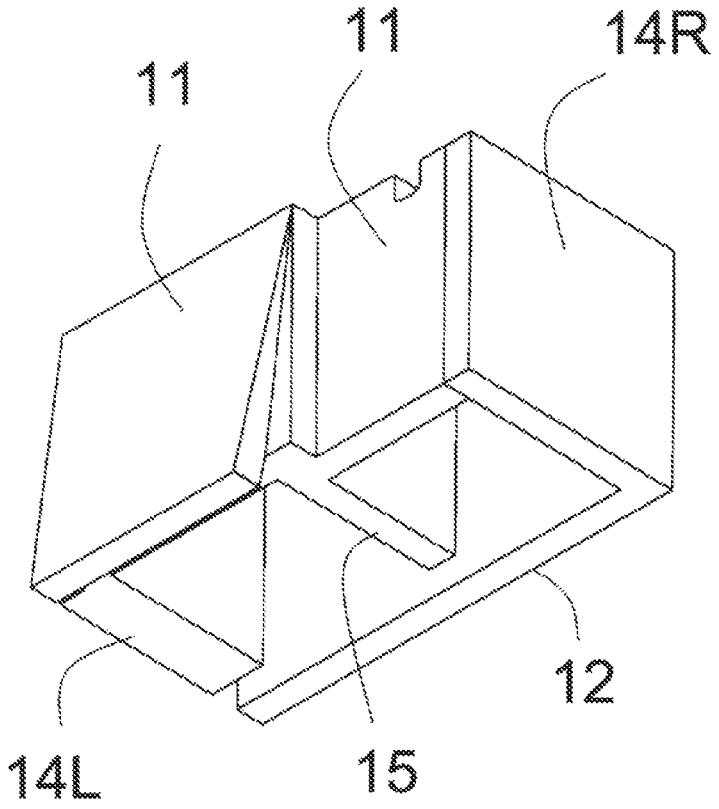

In general, none of the interlocking blocks comprises a solid top side. Some of the interlocking blocks may further comprise a solid base 13 but some may not. For example, the bond beam 2 has a solid base 13 (FIG. 2H) but the standard block 1 does not (FIG. 1H). Most of the interlocking blocks further comprise end shell(s) 14 but some may not. For example, the standard block has a right end shell 14R and a left end shell 14L (FIG. 1G) but the bond beam does not have any end shell (FIG. 2G). Some of the interlocking blocks may comprise web(s) 15 but some may not. For example, standard block has a web 15 (FIG. 1G) but right half flush 7 and left half flush 8 do not have any web (FIGS. 7G and 8G).

In most of the interlocking blocks of the present invention, the front shell 11 has a larger length (L1) than that of the rear shell 12 (L2) as shown in the side views C and D of FIGS. 1-10.

For interlocking purpose, although the rear shell 12 has a length (L2) same as the distance (d1) from the top edge 141 to the bottom edge 142 of the end shells 14, the top 121 of the rear shell 12 is lower than the top 141 of the end shell 14, creating a receiving site to accommodate the bottom 122 of the rear shell (projection) of a block stacked above. The bottom 122 of the rear shell 12 extends beyond the bottom 142 of the end shell 14, creating a projection to engage the rear top corner 123 of the rear shell (receiving site) of a block stacked beneath, providing stability.

The front shell 11 has a length (L1) larger than the distance (d1) between the top 141 and bottom 142 of the end shell 14. It is clearly shown in the side views C and D of FIGS. 1-10, the top edge 111 of the front shell 11 is leveled with the top 141 of the end shell 14 and the bottom edge 112 of the front shell extends beyond the bottom 142 of the end shell. The front shell further has a cutout 19 near the bottom edge 112 which is configured to match the front top corner 113 of the front shell so that the cutoff 19 can snugly fit over the front top corner 113 of a block stacked beneath, providing further stability.

In addition, this feature allows the exterior surface of the front shell sloped away from the joints between two adjoining blocks so that the rain will run down following the sloped exterior surface to the ground thus won't get into the connection joints.

Figure 13:
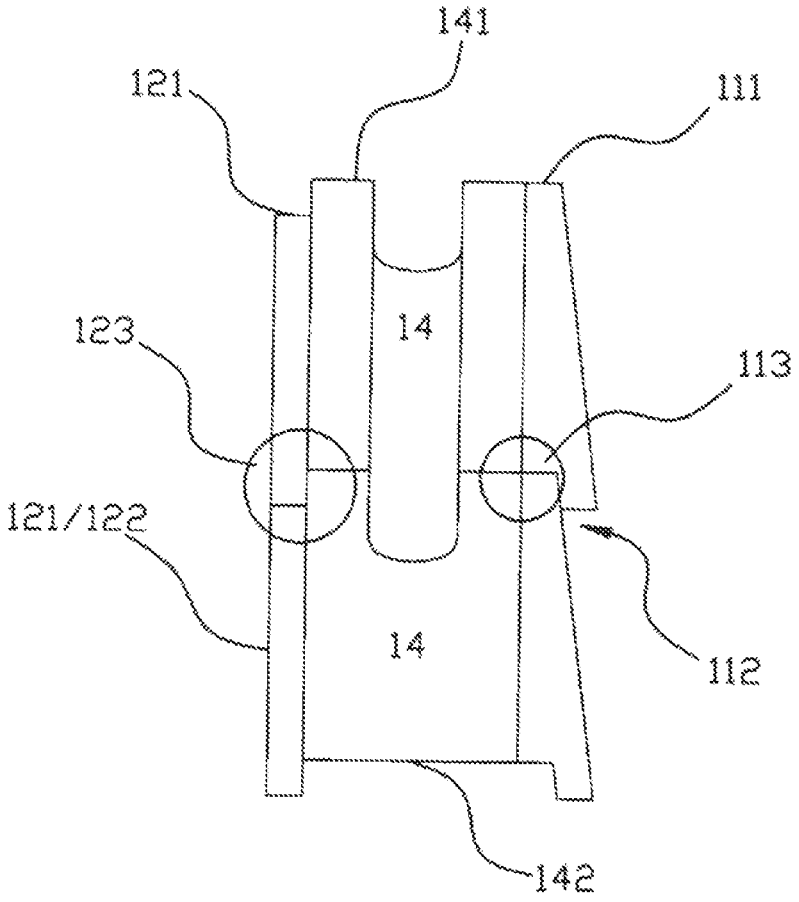
FIG. 13 which is a close-up side view of two blocks of the present invention stacked together using the standard block as an example.

The structural and functional relationships are clearly demonstrated in FIG. 13 which is a close-up side view of two blocks of the present invention stacked together using the standard block as an example.

The aforementioned features are universal in all 10 embodiments shown in FIGS. 1-10. These concrete blocks may be arranged and installed without mortar between the joints. In addition to the aforementioned features, individual embodiment may have their unique feature for different construction purpose.

For example, referring to FIG. 1, the standard block of the present invention has two cores 20 in this embodiment which allows steel reinforcing to be inserted into the assembly, greatly increasing its strength. In other embodiments, there may be more cores. A U-shaped groove 21 lies in the middle of the top edge of the end shell(s) 14 and webs 15 for the horizontal reinforcing rod to be inserted to provide horizontal stability across blocks.

Figure 14:
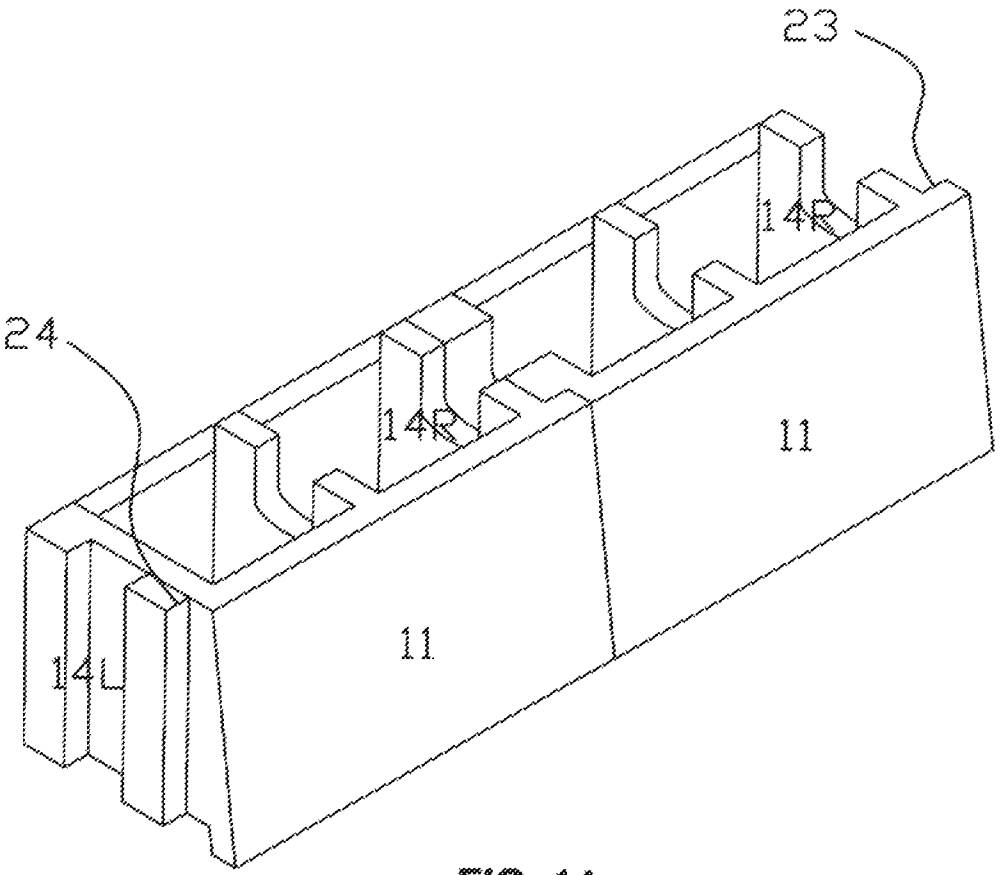
FIG. 14 which is a close-up side view of two blocks of the present invention jointed horizontally together using the standard block as an example.

Moreover, to interlock with blocks aligned horizontally, the right ends of both of the front and rear shells 11, 12 extend beyond the right end shell 14R, creating protrusions 23 for joining with an adjacent block on the right side, and the left ends being caved in from the left end shell 14L, creating a receiving corners 24 for receiving the protrusions 23 of the adjacent block on the left side. This feature can be clearly seen in FIGS. 1E and 1F. The structural and functional relationships are demonstrated in FIG. 14 which is a close-up side view of two blocks of the present invention jointed horizontally together using the standard block 1 as an example.

Figure 15:
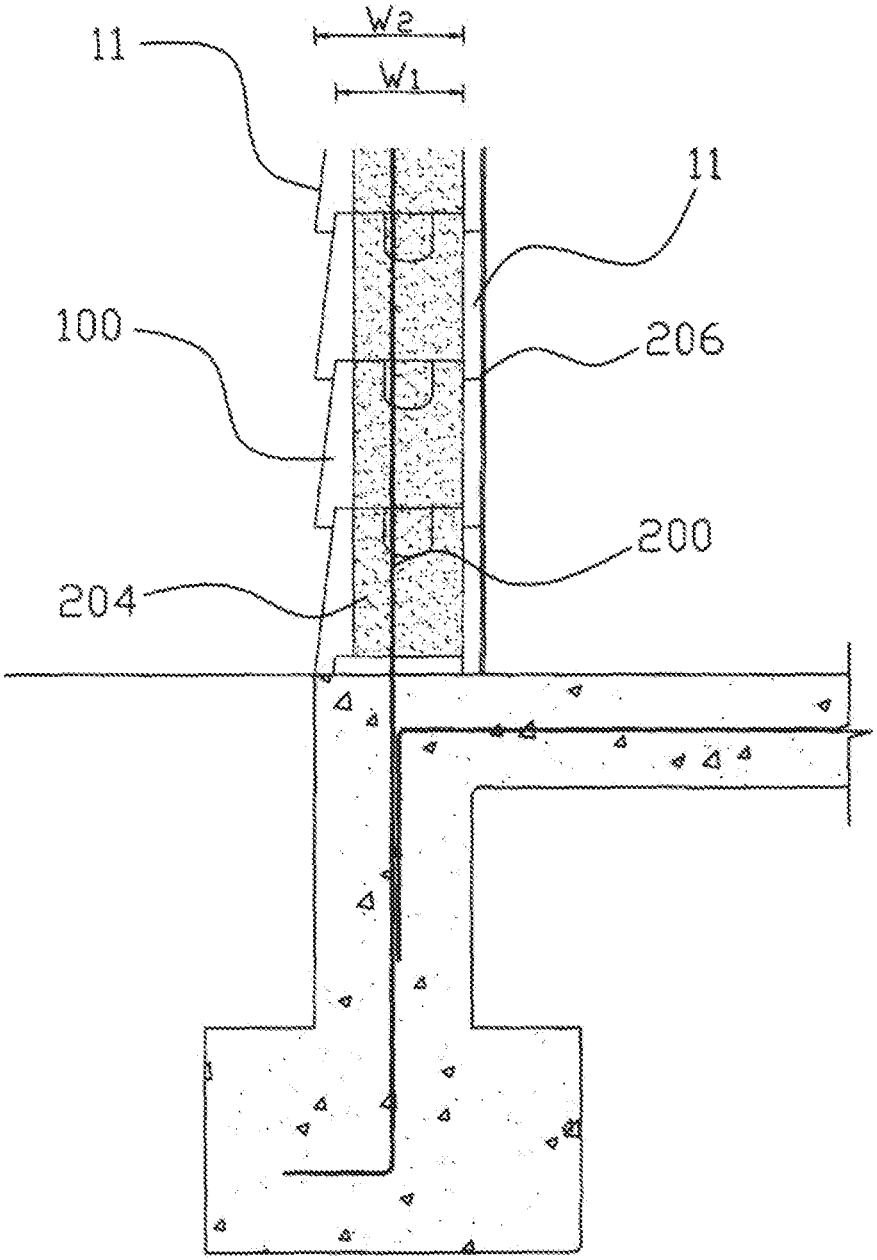
FIG. 15 shows a sectional view of a wall using the interlocking mortarless concrete blocks of the present invention.

Referring to FIG. 15, there is disclosed a sectional view of a wall using the interlocking mortarless concrete blocks of the present invention 100. As shown in the figure, it is obvious that the width of the block at the top (W1) is smaller than that at the bottom (W2). A vertical reinforcing rod 200 is inserted into the cores of the assembly to increase the strength. The reinforced cores are filled with grout 204 to secure the vertical reinforcing rod 200 in proper relationship to the structure, and to bond the blocks 100 and reinforcing. In this figure, the rear shell 12 is in contact with an interior finish wall 206.

Figure 16:
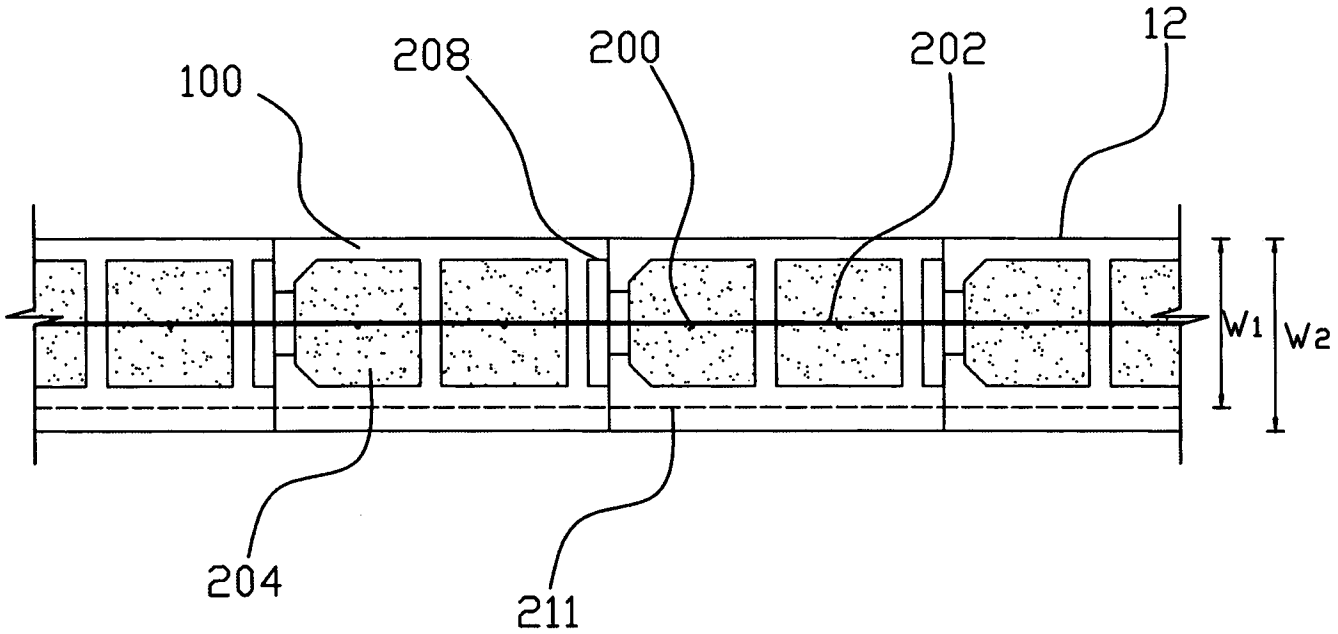
FIG. 16 shows a plan view of a wall using interlocking concrete blocks of the present invention.

Referring to FIG. 16, there is disclosed a plan view of a wall using interlocking concrete blocks 100 of the present invention. The dashed line indicates the location of the top edge 111 of the front shell 11. A Horizontal reinforcing rod 202 is placed inside the U-shaped groove 21 to enhance the stability across horizontally. The vertical reinforcing rod 200 is installed in each core 20 and secured by the filled concrete grout 204. For each of connection joints or corners, sealant may be applied to provide further stability to the vertical and horizontal connection.

Figure 17:
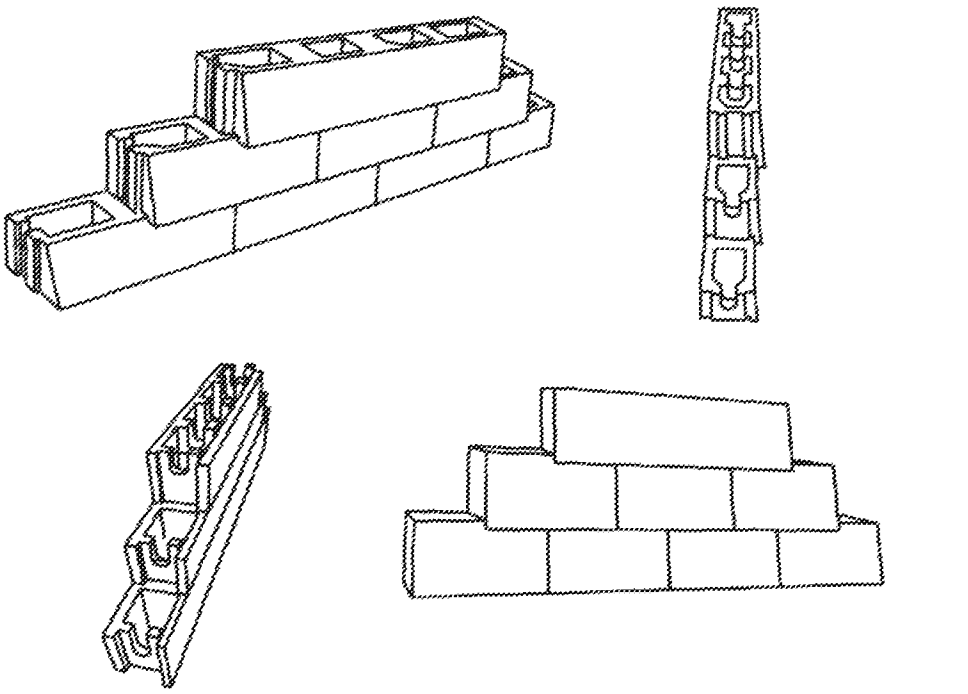
FIG. 17 shows several pictures of a prototype of sample concrete blocks of the present invention and a wall built using the prototype.

Referring to FIG. 17, there is disclosed several pictures of the prototype of the standard block according to the present invention and a sample wall built using such a prototype. Although some detail features presented in FIG. 1 and discussed earlier is missing (e.g. U-shaped groove in the middle of the end shell and web) from the prototype, the key improvement of these improved blocks which is the trapezoidal shape is clearly shown in the pictures.

Referring back to FIG. 2 for a bond beam 2 which has a solid base 13 but has no end shell(s) 14, the bond beam has a large groove 22 in the middle of the web(s) 15 for a beam to be placed into.

Referring to FIG. 5, the right flush block 5 has a shape/configuration similar to that of the standard block 1 except that the right flush block does not have a U-shaped groove in the middle of left end shell 14 L. Also, the right flush block does not have a receiving site 24 near the left end shell. Instead, the left end shell 14L is flush with the front and rear shells 11, 12 since this type of block will be installed in a wall along a right side of an entry or a door. The protrusion 23 of the right flush block may be received by the receiving site 24 of an adjoining standard block 1 that located on its right side.

Referring to FIG. 6, the left flush block 6 has a shape/configuration similar to that of the stand block 1 except that the left flush block does not have a U-shaped groove in the middle of the right end shell 14R. Also, the left flush block does not have a protrusion 23 near the right end shell. Instead, the right end shell 14R is flush with the front and rear shells 11, 12 since this type of block will be installed in a wall along a left side of an entry or a door. The receiving site 24 of the left flush block may receive the protrusion 23 of an adjoining standard block 1 that located on its left side.

Referring to FIG. 7, the right half flush block 7 is similar to the right flush block 5 in terms of structural features and function except that the right half flush block is almost half size of the right flush block.

Referring to FIG. 8, the left half flush block 8 is similar to the left flush block 6 in terms of structural features and function except that the left half flush block is almost half size of the left flush block.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A concrete block system for building a wall, the concrete block system comprising a standard block, a bond beam block, a right out corner block, a left out corner block, a right flush corner block, a left flush corner block, a right half flush block, a left half flush block, a left in corner block, and a right in corner block;

wherein each of the blocks having a substantially trapezoidal shape, being wider at bottom than at top, having a front shell and a rear shell, the rear shell being planar having a top edge, a bottom edge, a right edge, a left edge and a uniform width from the top to the bottom, the front shell being trapezoidal in shape having a top edge, a bottom edge, a right edge, a left edge, and being wider near the bottom than near the top;

wherein each of the blocks further having a left shell end and a right shell end which transversely connect the front and rear shells near their right and left edges, the end shells having top and bottom edges; wherein the rear shell has its top edge lower than the top of the end shells to receive the bottom of the rear shell of a block stacked above and has its bottom edge extending downwardly beyond the bottom of the end shells to fit over the rear top corner of a block stacked beneath; wherein the front shell has its top edge leveled with the top of the end shells and its bottom edge extending downwardly beyond the bottom of the end shells and has a cutout near the bottom to fit over the front top corner of the block stacked beneath and has its top edge leveled with the top of the end shells to engage the cutoff of the block stacked above;

wherein each of the blocks further having edges of both of the front and rear shells protruding out of an end shell creating protrusions to engage receiving corners of another block and having the edges of both of the front and rear shells caved in creating receiving corners from the other end shell to accommodate protrusions of another block.

2. The system of claim 1, wherein the blocks further having one or more webs parallel with and between the end shells and transversely connecting the front and rear shells.

3. The system of claim 2, wherein the blocks further having a U-shaped groove in the middle of the top edge of the end shell and/or web to accommodate a horizontal reinforcing bar to increase horizontal stability and strength across blocks.

4. The system of claim 3, wherein the standard block has the right edges of both of the front and rear shells protruding out of the right end shell creating protrusions to engage receiving corners of another block and have the right edges of both of the front and rear shells caved in creating receiving corners from the left end shell to accommodate protrusions of another block.

5. The system of claim 1, wherein the right out corner block, right flush block, right half flush block, and left in corner block have the right edges of both of the front and rear shells protruding out of the right end shell creating protrusions to engage receiving corners of another block and have the left edges of both of the front and rear shells flushed with the left end shell.

6. The system of claim 1, wherein the left out corner block, left flush block, left half flush block, and right in corner block have the left edges of both of the front and rear shells caved in from the left end shell creating receiving corners to accommodate protrusions of another block and have the right edges of both of the front and rear shells flushed with the right end shell.

7. The system of claim 1, wherein the bond beam block has a base connecting the front and rear shells near their bottom edges, two webs transversely connecting the front and rear shells and a large groove in the middle of the two webs to accommodate a beam.

8. A concrete block system for building a wall, the concrete block system comprising a plurality of concrete blocks, each of the blocks having a substantially trapezoidal shape, being wider at bottom than at top, having a front shell and a rear shell, the rear shell being planar having a top edge, a bottom edge, a right edge, a left edge and a uniform width from the top to the bottom, the front shell being trapezoidal in shape having a top edge, a bottom edge, a right edge, a left edge, and being wider near the bottom than near the top;

wherein the blocks further having a left shell end and a right shell end which transversely connect the front and rear shells near their right and left edges, the end shells having top and bottom edges; wherein the rear shell has its top edge lower than the top of the end shells to receive the bottom of the rear shell of a block stacked above and has its bottom edge protruding downwardly beyond the bottom of the end shells to fit over the rear top corner of a block stacked beneath; wherein the front shell has its top edge leveled with the top of the end shells and its bottom edge protruding downwardly beyond the bottom of the end shells and has a cutout near the bottom to fit over the front top corner of the block stacked beneath and has its top edge leveled with the top of the end shells to engage the cutoff of the block stacked above;

wherein the blocks further having edges of both of the front and rear shells protruding out of an end shell creating protrusions to engage receiving corners of another block and having the edges of both of the front and rear shells caved in creating receiving corners from the other end shell to accommodate protrusions of another block.

9. The system of claim 8, the blocks further having one or more webs parallel with and between the end shells and transversely connecting the front and rear shells.

10. The system of claim 8, the blocks further having a U-shaped groove lying in the middle of the top edge of the end shell to accommodate a horizontal reinforcing bar to increase horizontal stability and strength across blocks.

11. The system of claim 10, wherein the right edges of both the front and rear shells extend beyond the right end shell creating a protruding part to engage a block on its right side and the left edges of both the front and rear shells are caved in from the left end shell creating a receiving site to accommodate the protruding part of a block on its left side.

12. The system of claim 10, wherein the right edges of both the front and rear shells extend beyond the right end shell creating a protruding part to engage a block on its right side and the left edges of both the front and rear shells flush with the left end shell.

13. The system of claim 10, wherein the left edges of both the front and rear shells are caved in from the left end shell creating a receiving site to accommodate a protruding part of a block on its left side and the right edges of both the front and rear shells flush with the right end shell.

14. The concrete block system of claim 8, wherein the blocks further has a solid base connecting the front and rear shells at their bottoms, two webs transversely connecting the front and rear shells, and a large groove in the middle of the webs to accommodate a beam.

* * * * *